United States Patent [19]

Frey

[11] 4,055,106

[45] Oct. 25, 1977

[54] VARIABLE OUTPUT FLUID PUMP/MOTOR

[75] Inventor: Kenneth H. Frey, Hyattsville, Md.

[73] Assignees: Edward A. Byrne; Gladys U. Byrne, Lorton; Robert B. Morrison; Patricia A. Morrison, Fairfax, all of Va. ; part interest to each

[21] Appl. No.: 528,406

[22] Filed: Nov. 29, 1974

[51] Int. Cl.[2] ..... F01B 3/10; F01B 3/00

[52] U.S. Cl. ..... 91/495; 417/465; 92/119

[58] Field of Search ..... 91/479, 481, 491, 495; 417/270, 273, 464, 465; 92/182, 177

[56] References Cited

U.S. PATENT DOCUMENTS

| | | | |
|---|---|---|---|
| 1,416,314 | 5/1922 | Atkins | 417/465 |
| 1,618,333 | 2/1927 | Green | 91/479 |
| 1,675,546 | 7/1928 | Green | 417/465 |
| 1,703,108 | 2/1929 | Huid | 417/465 |
| 1,925,333 | 2/1932 | McCarty | 91/479 |
| 1,982,958 | 12/1934 | Kraus | 417/221 |
| 2,023,609 | 12/1935 | Nelson | 92/177 |
| 2,257,854 | 10/1941 | Peterson | 417/221 |
| 2,301,130 | 11/1942 | Le Valley | 417/464 |
| 2,466,193 | 4/1949 | Anderson | 417/465 |
| 2,468,980 | 5/1949 | Huber | 92/182 |
| 2,518,830 | 8/1950 | Staats | 91/481 |
| 2,544,055 | 3/1951 | Staats | 91/481 |
| 2,573,472 | 10/1951 | Martin | 417/465 |
| 3,242,869 | 3/1966 | Komkys | 417/465 |
| 3,246,604 | 4/1966 | Brailsford | 417/465 |
| 3,407,743 | 10/1968 | Landreau | 91/479 |
| 3,591,318 | 7/1971 | Knapp | 417/465 |

FOREIGN PATENT DOCUMENTS

| | | | |
|---|---|---|---|
| 1,102,636 | 10/1955 | France | 92/177 |
| 670,219 | 12/1938 | Germany | 92/177 |
| 884,556 | 12/1961 | United Kingdom | 417/273 |

*Primary Examiner*—William L. Freeh
*Attorney, Agent, or Firm*—William F. Frank

[57] ABSTRACT

The present invention comprises a fluid pump motor unit and a controller unit which controls the output of the pump/motor irrespective of the speed of the power source driving the pump/motor unit.

The pump/motor unit comprises a cylindrical housing within which there is arranged at least one rectangular expansible cylinder assembly mounted on a crankshaft in a radial pattern, the cylindrical assembly being pivotally mounted within the housing for movement about trunnions, the rectangularly adapted piston assembly within said housing being journaled on a crankshaft which crankshaft with respect to the centerline of the cylindrical housing has a rotation parallel to, but spaced from, the centerline of the housing. The pivotal oscillation of each cylinder assembly alternately opens a port for the inflow of a fluid and subsequently closes that port while simultaneously opening another port for the outward flow of the fluid under compression as the piston moves toward the top of the chambers. Novel means are provided to seal the side walls of the cylinder with the end plates of the housing and additional novel means are provided to seal the piston and cylinder during the movement of the piston therein. The invention also provides for intake and outward flow of the fluid within the housing through the end plates by means of conduits contained therein.

The controller unit encompassed within the present invention comprises a shaft keyed to the crankshaft of the pump/motor unit, a pair of rotatable sleeves, one within the other, the latter keyed to the shaft keyed to the crankshaft, the sleeves being counter rotatable with reference to each other, each having a helical groove therein substantially disposed 180 degrees along the circumference of each sleeve relative to each other and intersecting each other, the two grooves thus providing a camming surface in which a pin inserted within the two grooves can be moved by another pin operating in an arcuately inclined groove in another sleeve on a control rod which is rotatable between positions which place the crankshaft rotatable between positions which place the crankshaft of the pump/motor unit in aspects ranging from full forward position to neutral.

43 Claims, 29 Drawing Figures

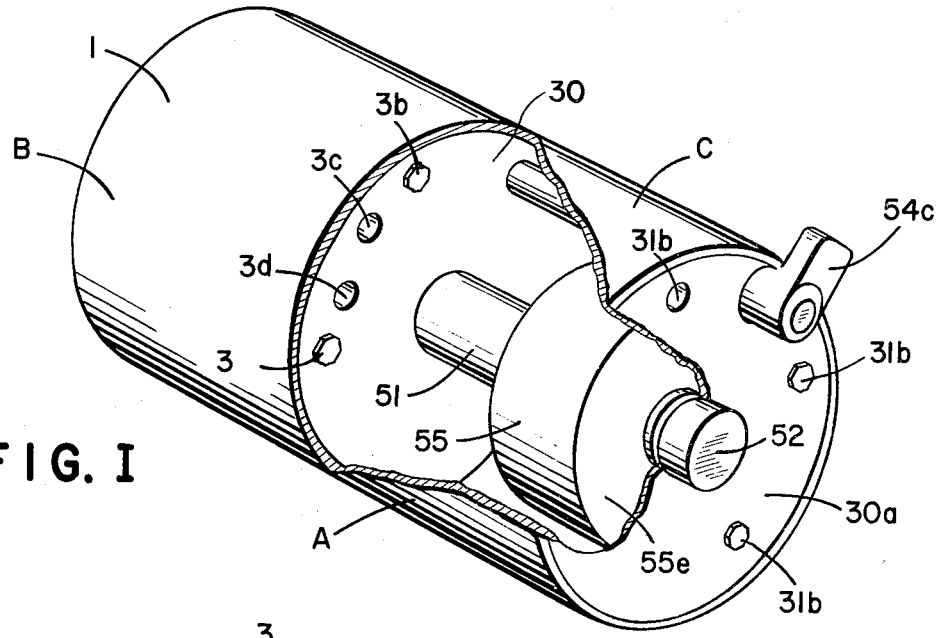
FIG. I
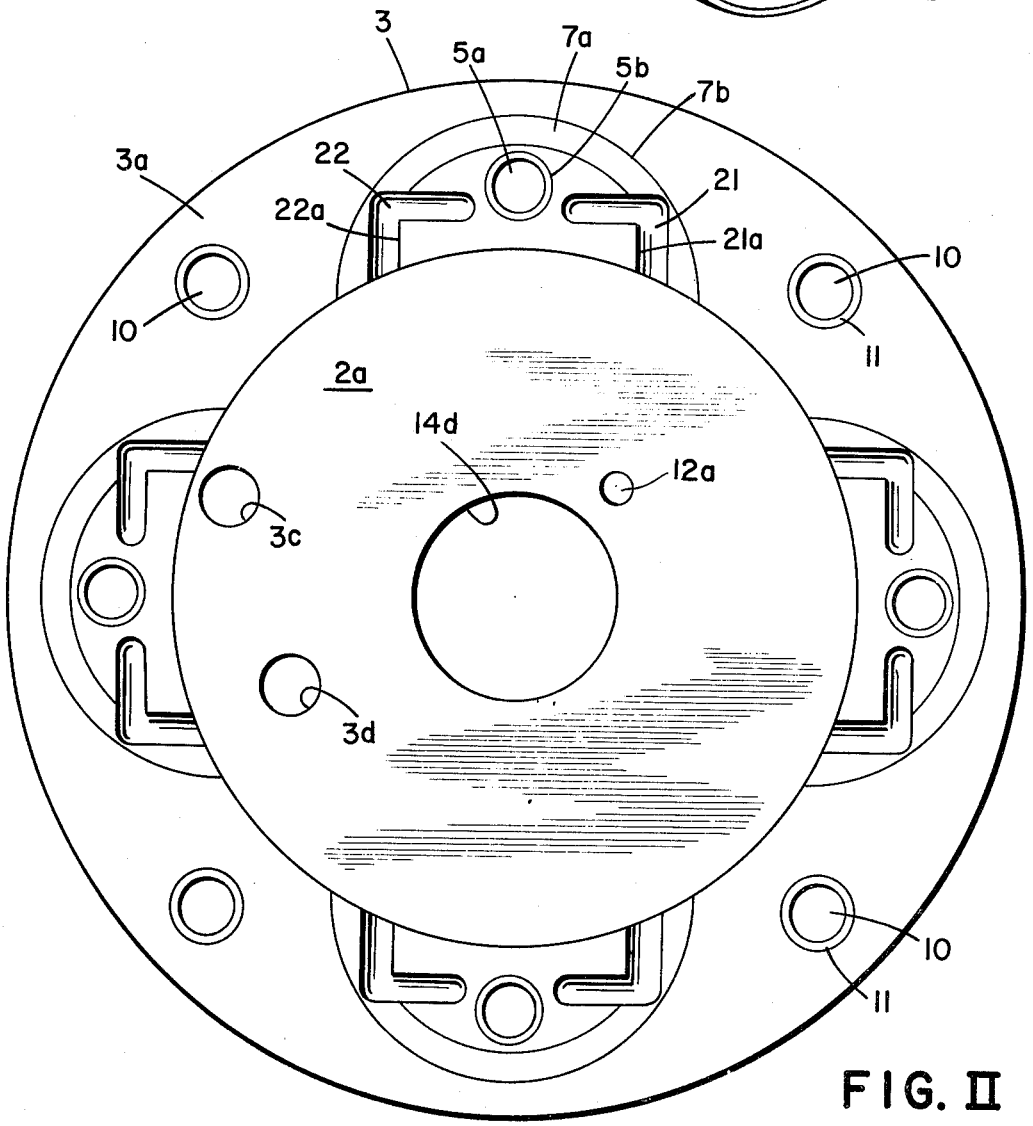
FIG. II

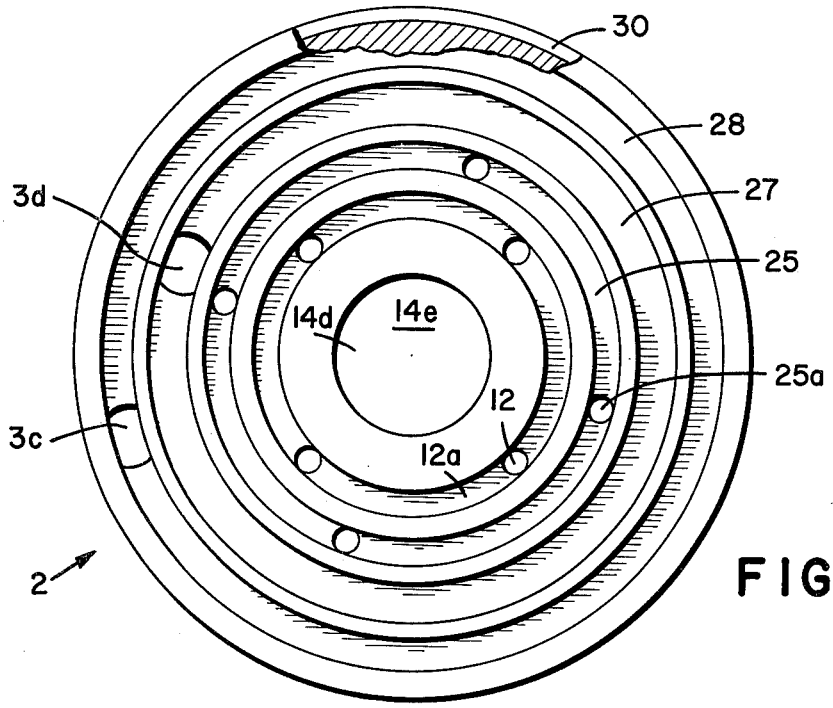
FIG. III
FIG. IV
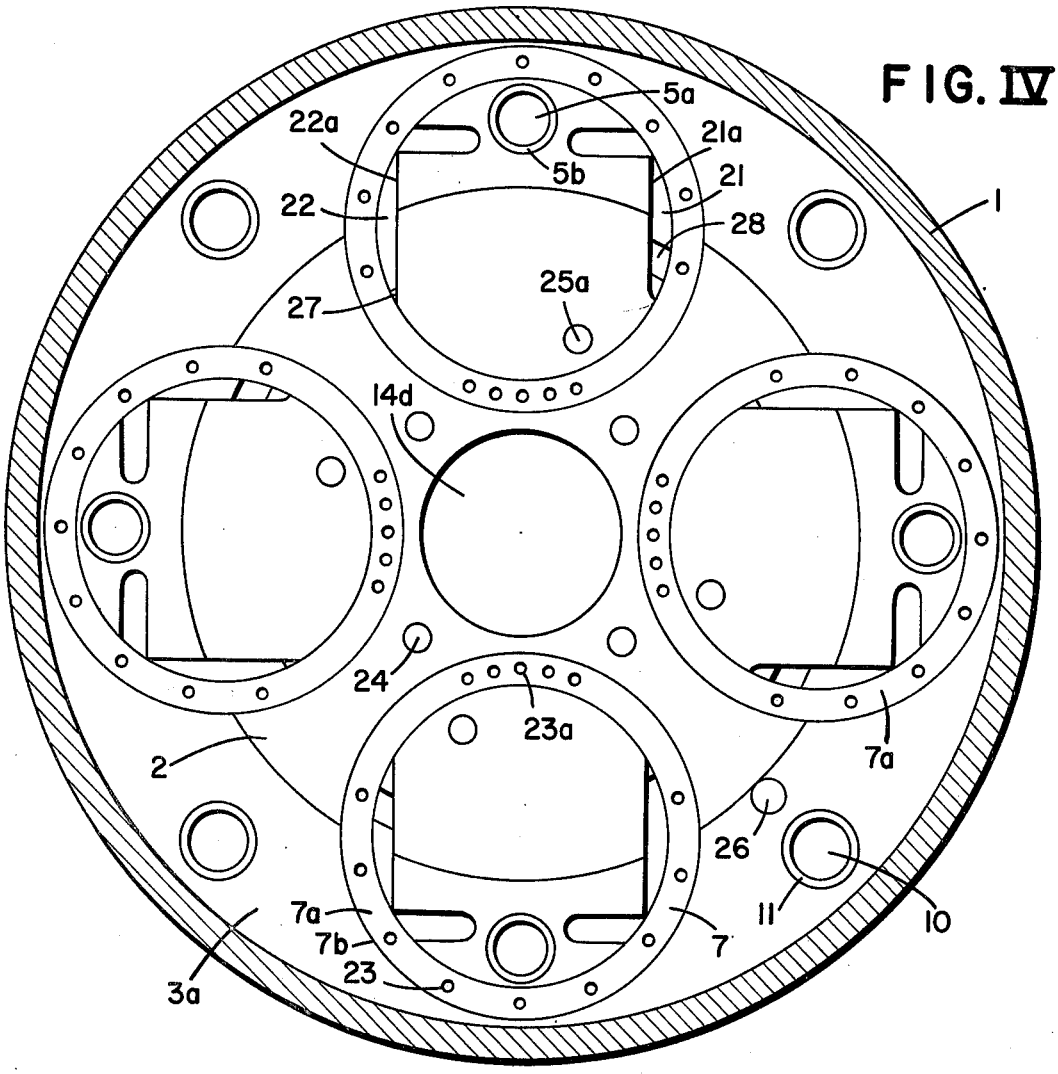

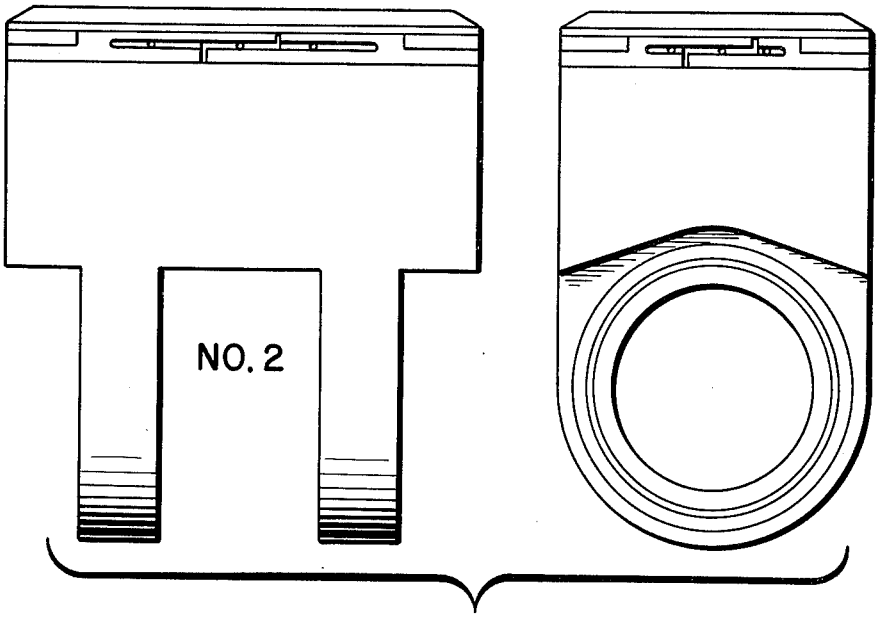
FIG. XI
FIG. V
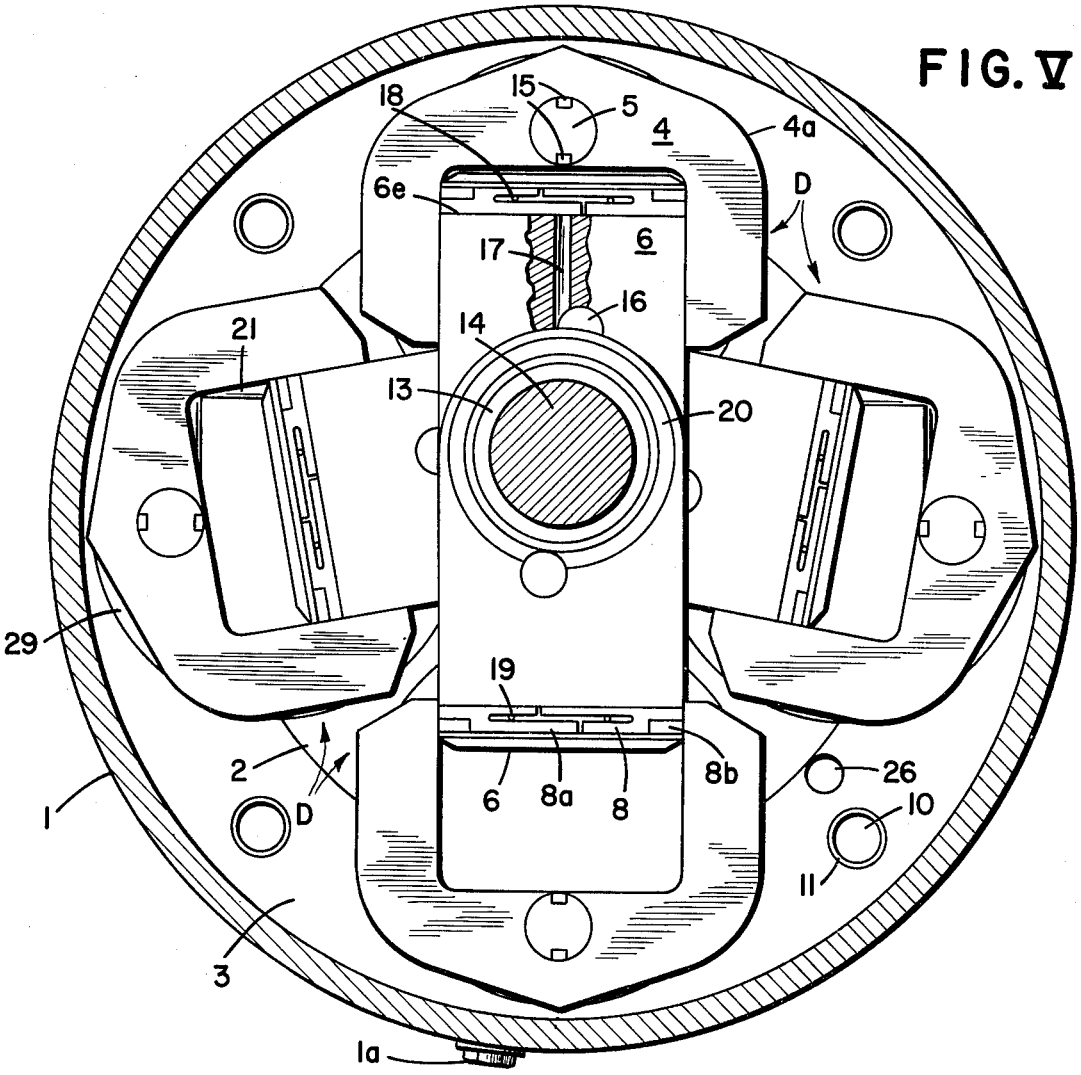

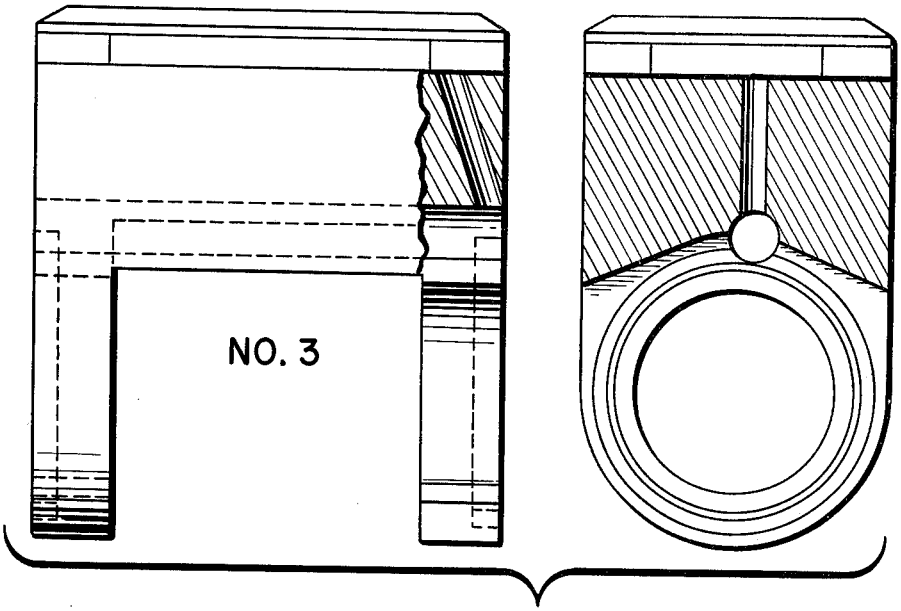
FIG. XII
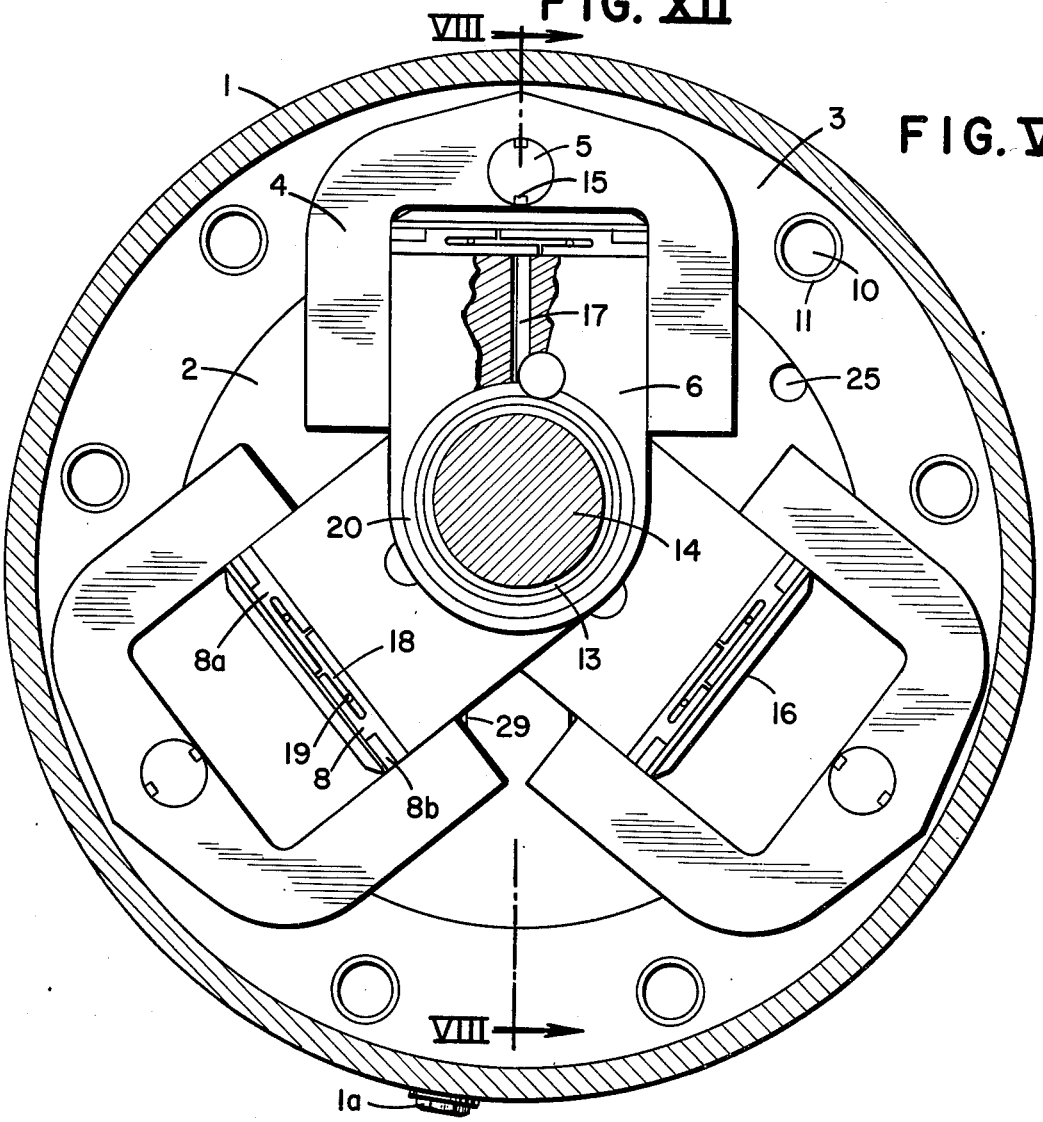
FIG. VI

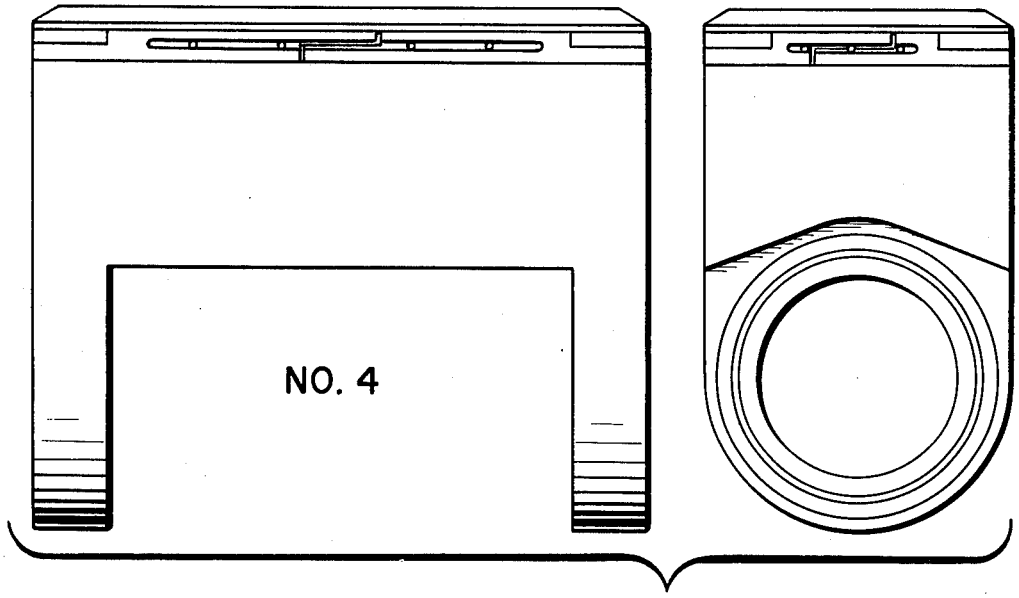
FIG. XIII
FIG. VII
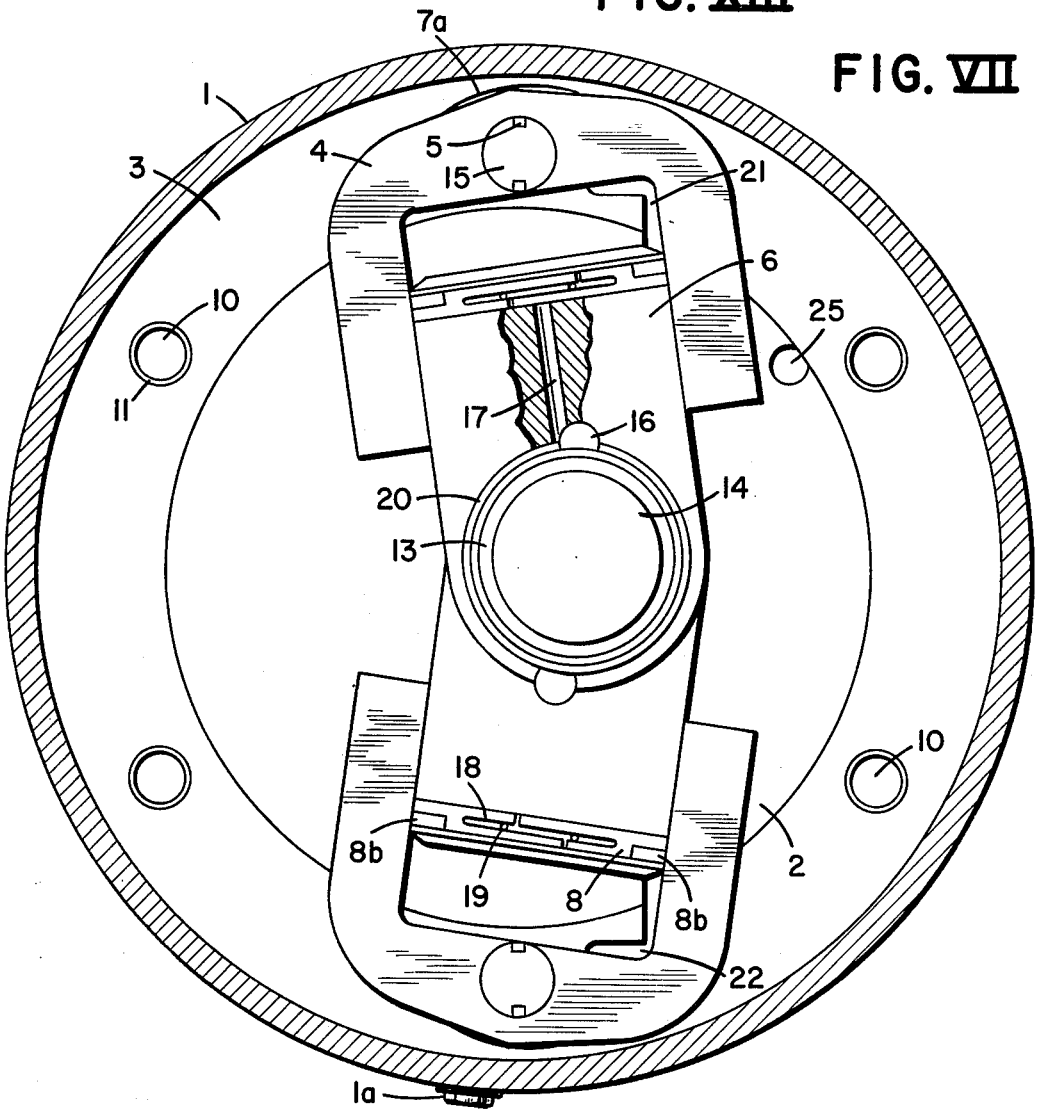

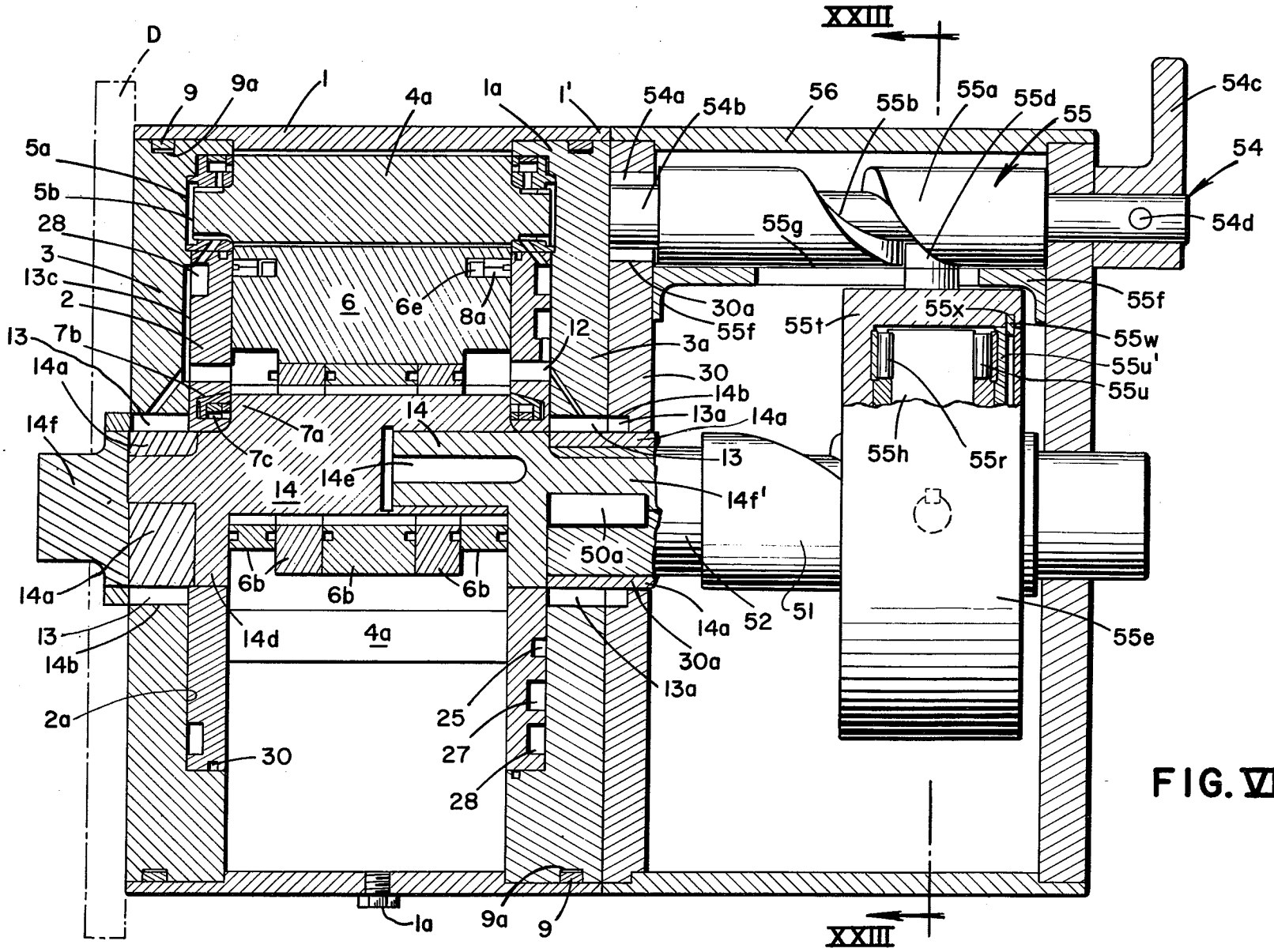
FIG. VII

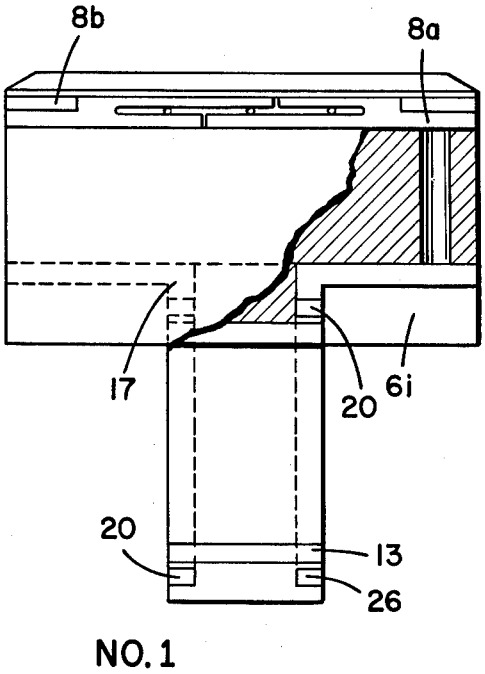
FIG. X
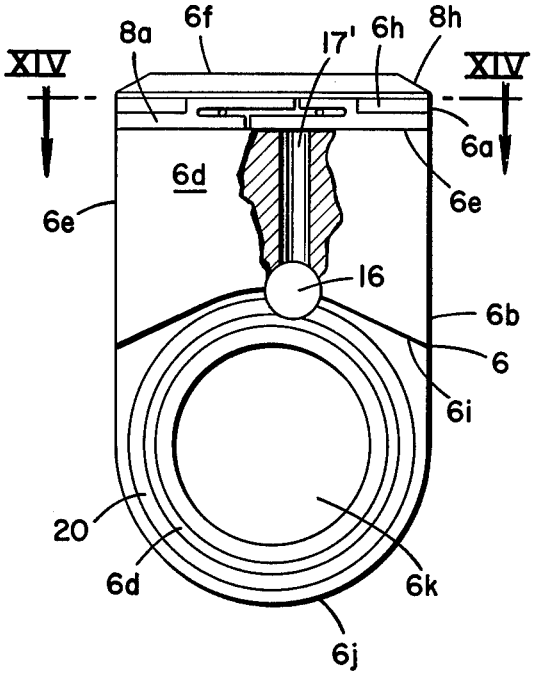
FIG. IX

FIG. XIVd
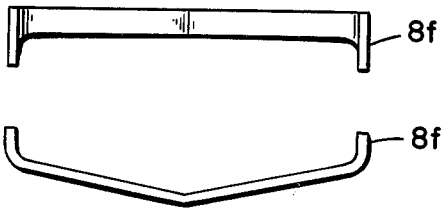
FIG. XIVc
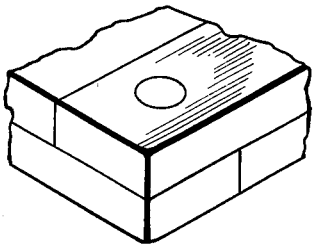
FIG. XIVb
FIG. XIVa
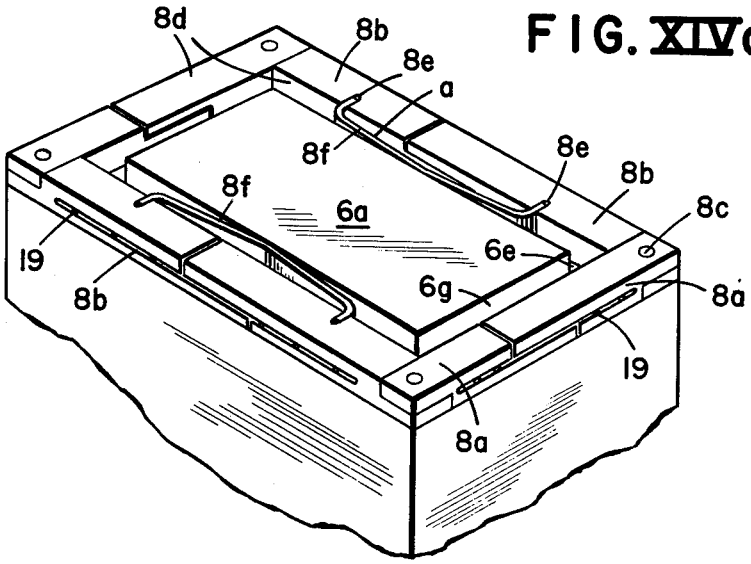
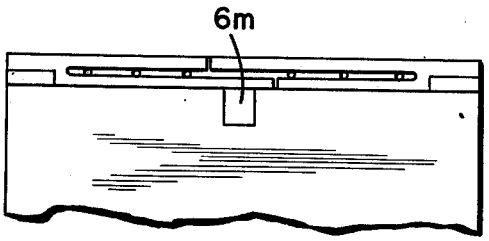
FIG. XV

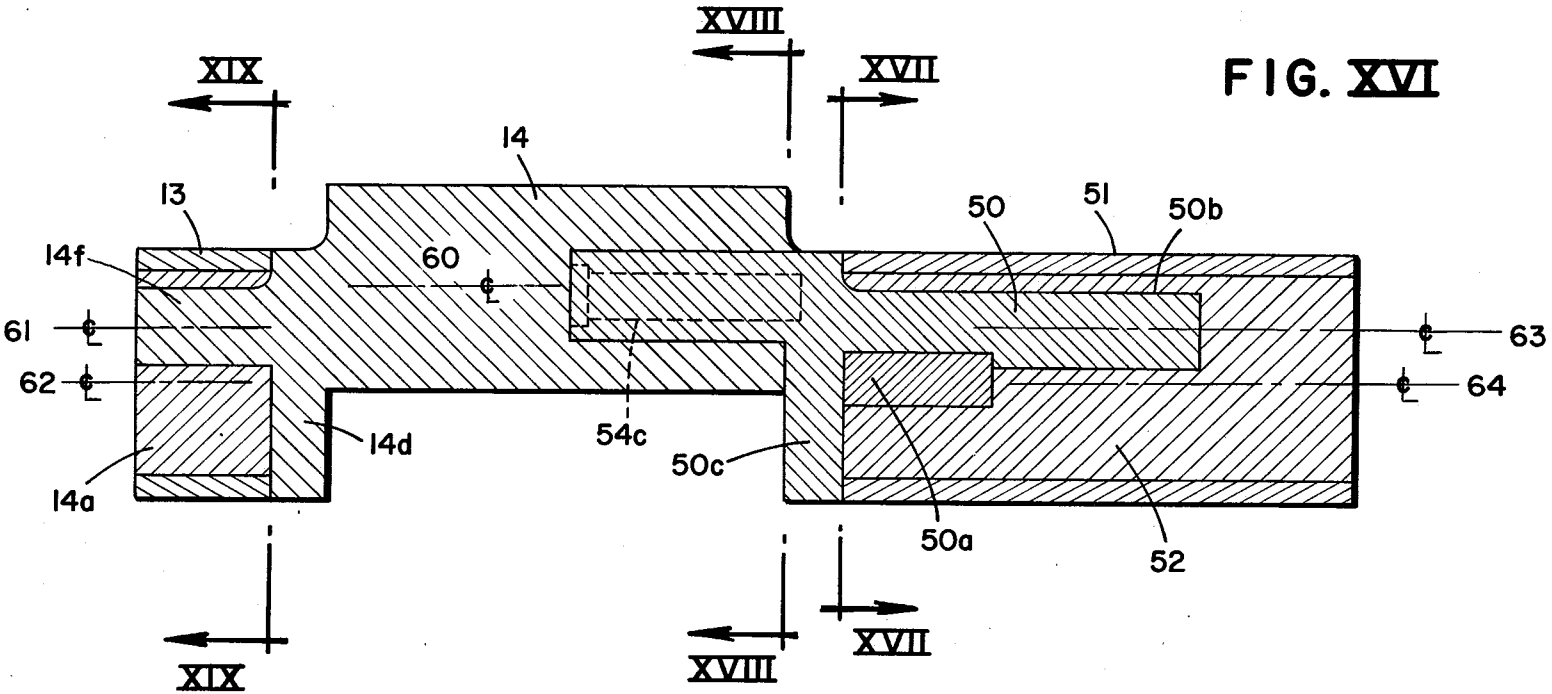
FIG. XVI
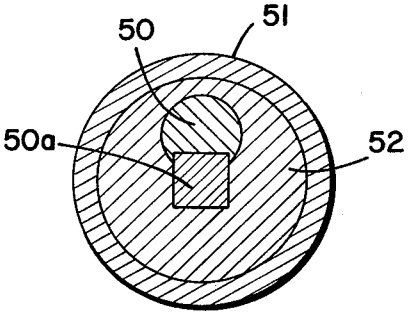
FIG. XVII
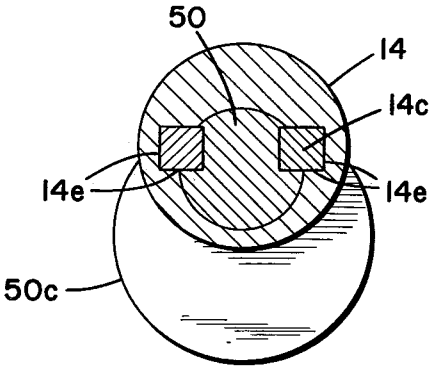
FIG. XVIII
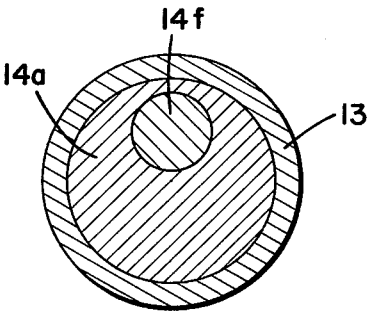
FIG. XIX

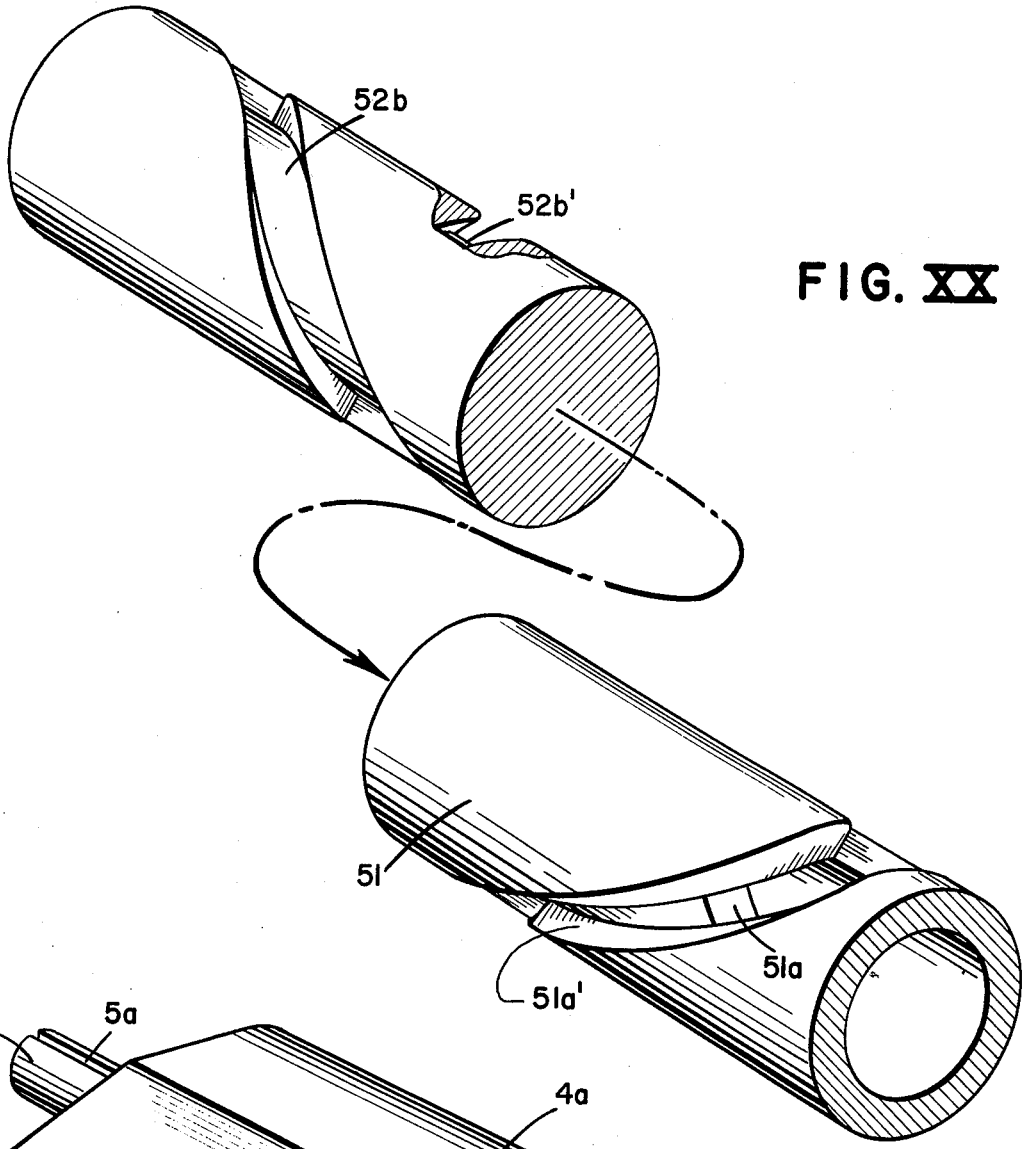
FIG. XX
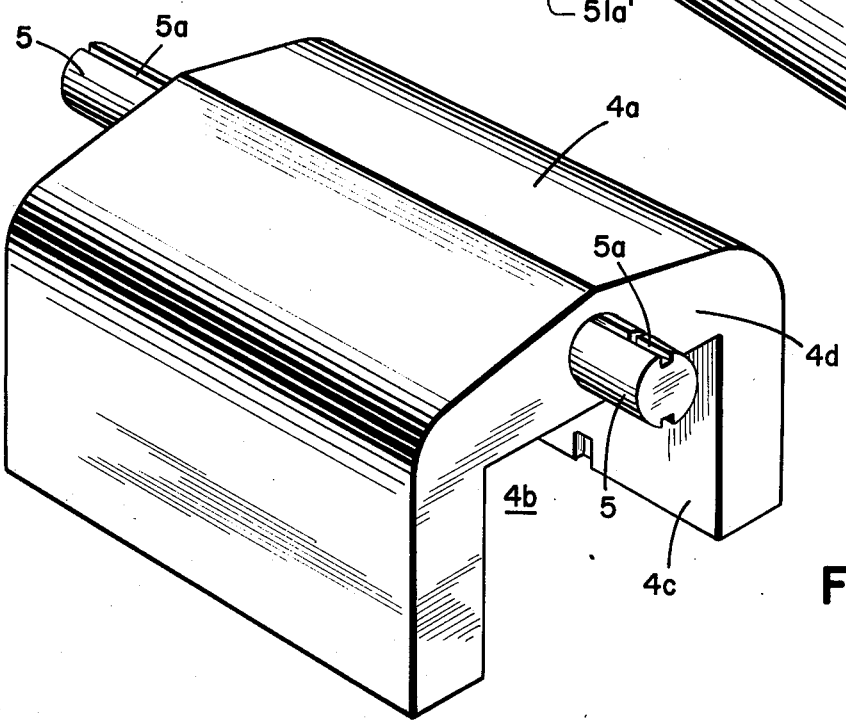
FIG. XXII

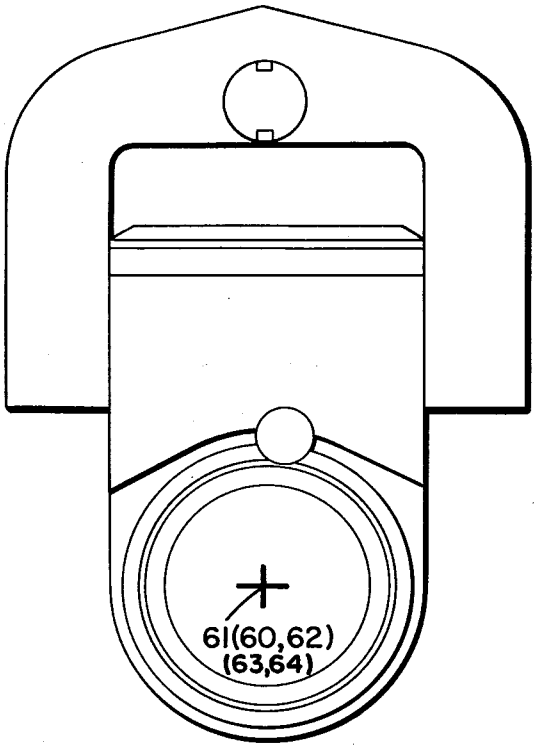
FIG. XXIc
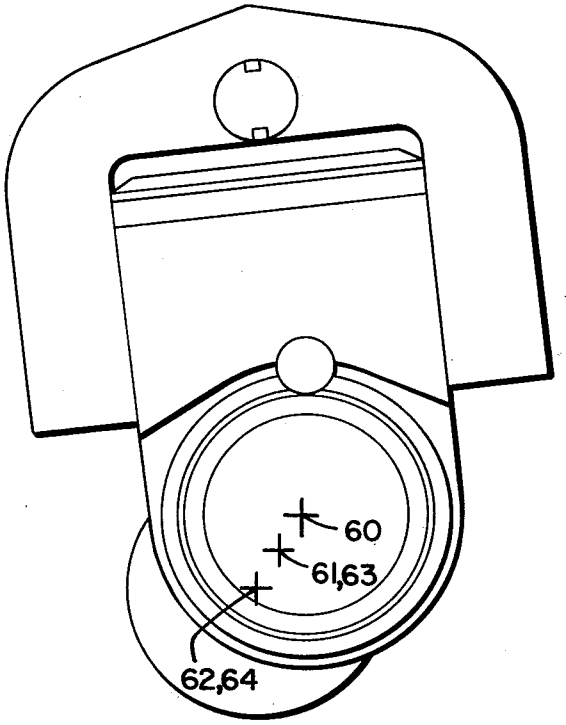
FIG. XXIb
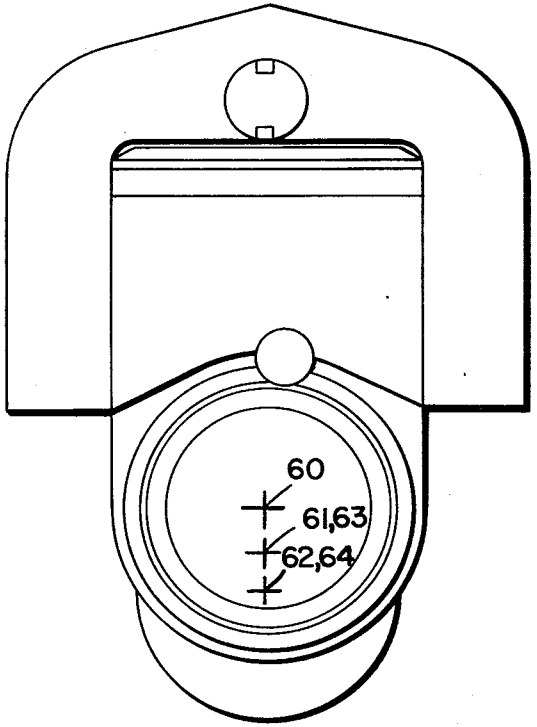
FIG. XXIa

FIG. XXIII
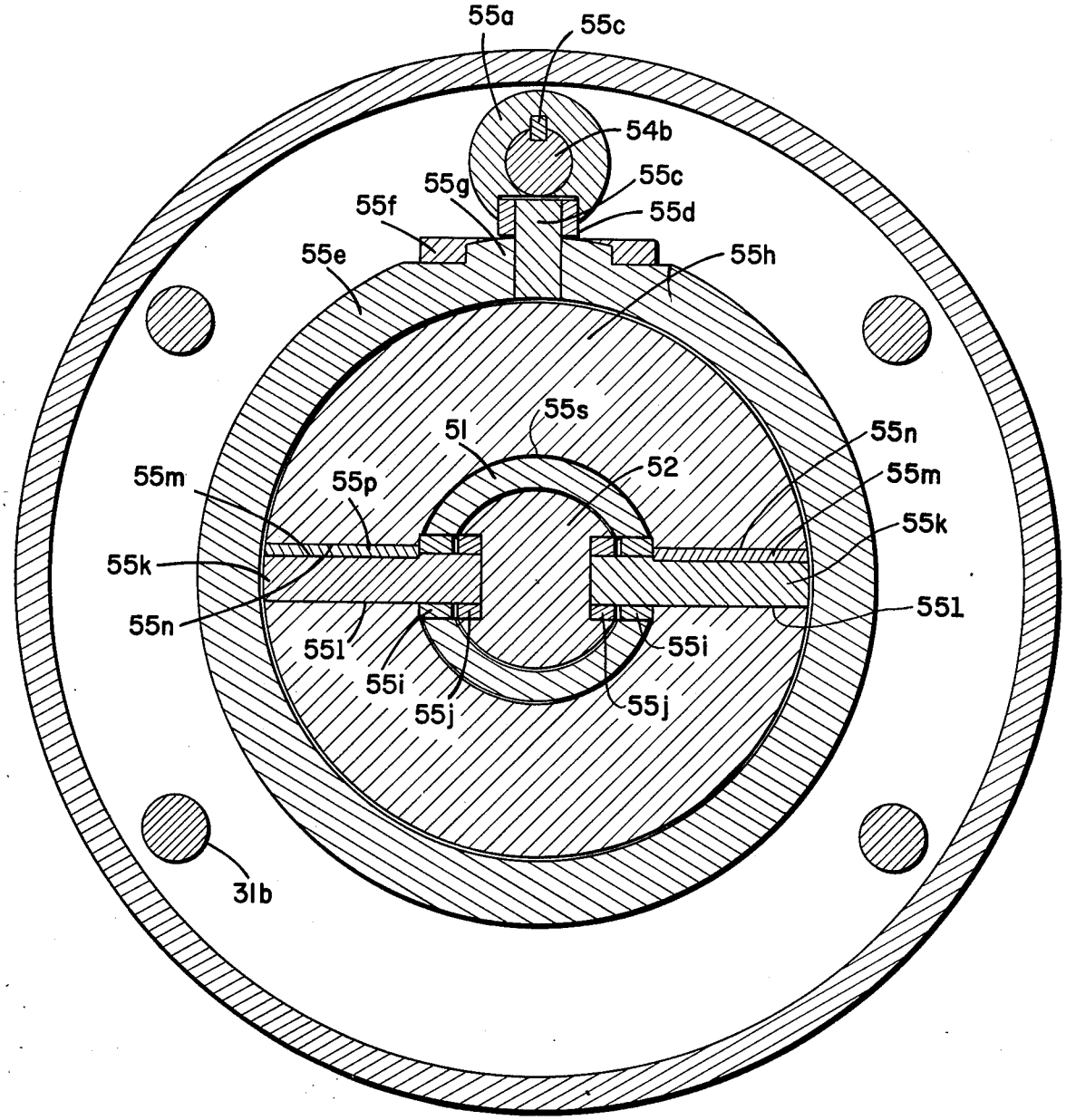

FIG. XXIV
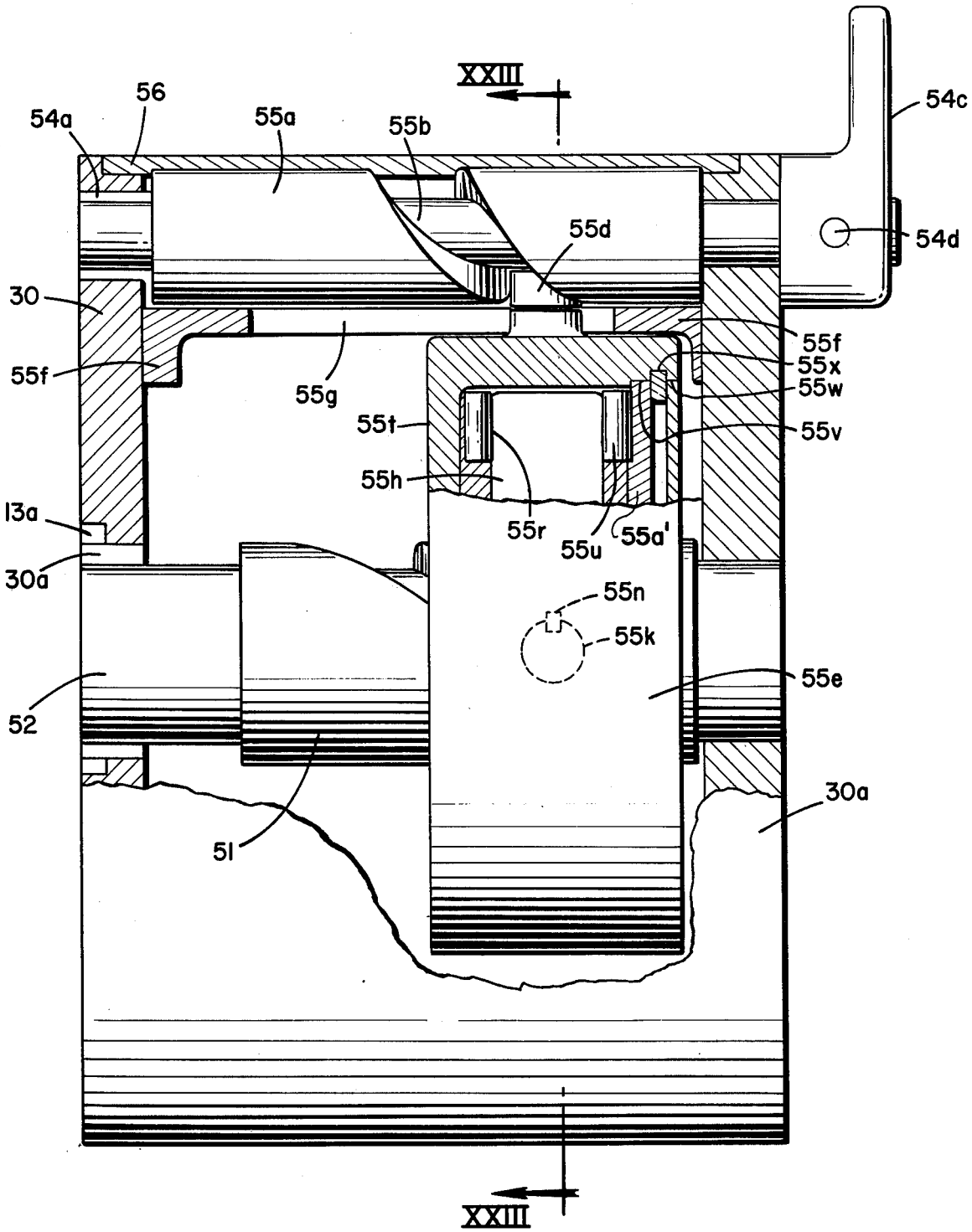

VARIABLE OUTPUT FLUID PUMP/MOTOR

FIELD OF INVENTION

The present invention lies in the field of mechanisms which through compressive forces provide for the movement of fluids to create motive power for the propulsion of fluids and the employment of such fluids to create propulsive factors. More specifically, the present invention relates to fluid pumps which can be equally employed as fluid driven motors and more particularly, to such pumps/motors in which the compression chambers oscillate within a housing.

BACKGROUND OF THE INVENTION AND PRIOR ART

Devices which utilize compression chambers to move fluids therethrough have long been known and employed. These conventionally known devices can be generally grouped into these two categories. The first is having true and predetermined compression chambers with articulated pistons moving within the chambers in a staggered sequence to draw in fluids and exhaust these fluids through a complex arrangement of valve assemblies, compressing ports, valves, valve actuating mechanisms, valve actuating mechanism control devices and equally complex arrangements relating to the operation of the compressive chambers themselves. The other category utilizes a series of conventional compression chambers and very complex system of valving cooperating with these compression chambers to move fluid through the mechanisms to accomplish the same mechanical result.

Not unsurprisingly, these known devices have followed the structure of conventional compression mechanisms unchanged from the time of the first practical utilization of the steam engine. These devices utilize a housing having fixed cylinderical chambers within which articulated pistons mounted on angular crankshafts are moved up and down. The intake and exhaust systems for fluids to be propelled by the compressive forces developed by the interaction of such chambers and piston are complex mechanisms within themselves, relying upon cams, springs and similar acting means to be opened for the introduction and exhausting of fluids to which compressive forces developed by the interaction of the pistons within the chambers.

There have been limited known developments to simplify not only the compression chambers but also to simplify the mechanisms for the intake and exhaust of fluids through such compression chambers. There have been a few innovators who chose to reverse the conventional compression devices by employing oscillating compression chambers within which conventional articulating pistons moved up and down.

SUMMARY OF THE PRESENT INVENTION

The present invention markedly differs from the known art in several aspects. First of all, the invention comprises a fluid pump/motor unit and a controller unit which controls the output of the pump/motor irrespective of the speed of the power source driving the pump/motor unit. For example, the pump/motor unit can be put into a neutral position by the controller unit and the power source turned on in the instance of electric motor drive or started up in the instance of an internal combustion engine. The speed of the power source can be set as desired, then the controller unit may be actuated between neutral and full forward output of the pump/motor unit. The speed of the power source may be increased or decreased and the volume of output can be maintained by moving the controller toward neutral or toward the full forward position respectively. The output from the pump/motor unit may be stopped simply by putting the controller in neutral and without changing the speed of the controller.

Secondly, the present invention includes a unit which, when separated from the controller unit, can be used as a fluid pump or as a motor actuated by a fluid pressurized source. The latter can be the pump unit itself. There is no requirement that the pump unit be directly connected to the motor aspect unit, yet such an arrangement is encompassed within the present invention. In such a combination, the controller unit is interposed between the pump aspect unit and the motor aspect unit. In such a combination, it is the control of the flow of fluid between the two identical units which establishes the driving unit. It is also within the scope of the present invention to separate the pump aspect unit from the motor aspect unit, employ the controller unit with the pump aspect unit and interconnect the pump aspect unit with the motor aspect unit by means of conduits so that the motor unit can be positioned in direct connection with the elements to be driven by the motor aspect unit. As an example, in a boat, the pump and controller assembly disclosed herein can be connected to the boat's engine. Conduits may be laid to the motor aspect which is directly connected to the shaft of a propellor assembly.

In the present invention, the pump/motor unit comprises cylindrical housing within which there is arranged at least one rectangular expansible cylinder assembly mounted on a crankshaft in a radial pattern, the cylindrical assembly being pivotally mounted within the housing for movement about trunnions, the rectangularly adapted piston assembly within said housing being journaled on a crankshaft which crankshaft with respect to the center line of the cylindrical housing has a rotation parallel to but spaced from the center line of the housing. The pivotal oscillation of each cylinder assembly alternately opens a port for the inflow of a fluid and subsequently closes that port while simultaneously opening another port for the outward flow of the fluid under compression as the piston moves toward the top of the chambers. Novel means are provided to seal the side walls of the cylinder with the end plates of the housing and additional novel means are provided to seal the piston and cylinder during the movement of the piston therein. The invention also provides for intake and outward flow of the fluid within the housing through the end plates by means of conduits contained therein. Lubrication of the moving parts is provided by non-fluid means as well as by the flowing of a liquid lubrication under pressure in conduits within the end portions of the moving parts of the invention. In certain applications or usages of the pump/motor aspect, frictionally engaging surfaces may be coated with any of the presently, or to be developed in the future, well known lubricating compositions, such as TEFLON.

The controller unit encompassed within the present invention comprises a shaft keyed to the crankshaft of the pump/motor unit, a pair of rotatable sleeves, one within the other, the latter keyed to the shaft keyed to the crankshaft, the sleeves being counter rotatable with reference to each other, each having a helical groove therein substantially disposed 180° relative to each other, the two grooves thus providing an intersecting camming surface in which a pin inserted within the two grooves can be moved by another pin operating in an arcuately inclined groove in another sleeve on a control rod which is rotatable between positions which place the crankshaft rotatable between positions which place the crankshaft of the pump/motor unit in aspects ranging from full forward position to neutral.

The present invention also encompasses novel sealing means for the pivotal cylinders and novel sealing means for the rectangular piston assembly within each cylinder.

BRIEF DESCRIPTION OF THE DRAWINGS

The present invention in its various embodiments and uses is graphically presented in the drawings which are illustrative and do not limit the invention is size or components. The drawings present the invention in varying scales which are dependent upon the presentation of the embodiments and uses of the invention according to the detail deemed necessary for clarity in understanding the structure and the operation of the invention.

For different embodiments of the invention, identical views are not presented in all instances. Since most of the components are identical and vary only by the number required, it is believed that those of skill in the art will understand how they would be arranged in operational relationships if they are not shown in the drawing figures.

Similarly, since many components are identical, the same reference numerals are employed for the different embodiments.

FIG. I is a perspective view of the fluid pump/motor and controller assembled, a portion of the housing for the controller being broken away to show the fluid ports and relationship of the controller to the other unit.

FIG. I*i* is an elevation view of the interior surface of the output side end plate of the pump/motor unit.

FIG. III is an elevation view of the underside of the adaptor plate which is fitted into each end plate of the pump/motor unit.

FIG. IV is an elevation view of the interior surface of either end plate of the pump/motor unit ready for assembly of the unit when employed with the 4-cylinder embodiment of the present invention.

FIG. V is an end view of the pump/motor unit with the output side end plate removed showing the arrangement of the 4-cylinder embodiment.

FIG. VI is an end view of the pump/motor unit with the output side end plate removed showing the 3-cylinder embodiment of the invention.

FIG. VII is an end view of the pump/motor unit with the output side end plate removed showing the 2-cylinder embodiment of the invention.

FIG. VIII is a cross-section of FIG. VI along the plane VIII—VIII in that figure and includes an elevation of the controller unit in partial section.

FIG. IX is an elevation end view in partial section of the number 1 piston of the present invention.

FIG. X is an elevation side view in partial section of the number 1 piston of the present invention.

FIG. XI is a side view and an end view, both in elevation, of the number 2 piston of the present invention.

FIG. XII is a side view and an end view, both in elevation and both in partial section, of the number 3 piston of the present invention.

FIG. XIII is a side view and an end view, both in elevation, of the number 4 piston of the present invention.

FIGS. XIV *a, b, c* and *d* are a top view in perspective of any of the 4 piston types along the plane XIV—XIV of FIG. IX.

FIG. XIB*b* is an enlarged perspective of the corner assembly of the piston seal shown in FIG. XIV*a*.

FIG. XIV*c* is a top plan view of the piston seal spring shown in FIG. XIV*a*.

FIG. XIV*d* is an elevation view of the open side of the spring shown in FIG. XIV*c*.

FIG. XV is a partial side elevation view of one of the piston seal assemblies shown in FIG. XIV*a*.

FIG. XVI is a sectional view of the crankshaft of the pump/motor unit and the control shaft of the controller unit taken along the axial center line of the two shafts.

FIGS. XVII, XVIII and XIX are cross-sectional views of the shafts in FIG. XVI along the planes XVII, XVIII and XIX in the Figure.

FIG. XX is a perspective view of the controller cam sleeves shown in FIG. XVI.

FIGS. XXI*a*, XXI*b*, XXI*c* and XXI*cr* schematic showings of the relative axial position of the cylinder, piston and crankshaft and the relative axial positions of the cam shaft and controller cam at the two maximum operating positions and the intermediate operating position of the controller unit.

FIG. XXII is a perspective of the cylinder of the present invention.

FIG. XXIII is a cross-sectional view of the controller unit taken along plane XXIII—XXIII in FIG. VIII.

FIG. XXIV is a side elevation of the controller unit in partial section.

DETAILED DESCRIPTION OF THE INVENTION

The following description of the structure of the invention in its various embodiments with reference to the drawings will aid in understanding the subsequently-to-be-described functioning of the various components of the invention.

In FIG. I, A designates the assembled unit of the invention whether the unit is to be employed as a pump or a motor. B designates the pump/motor unit, and C designates the controller unit. The housing for the pump/motor unit comprises a cylindrical sleeve 1 which is fitted between end plates 3 and 3*a* (FIG. XVIII), being the power side and plate and the output side end plate respectively. A plurality of housing bolts 3*b* pass through end plate 3*a* and are secured in end plate 3. At least one inlet port 3*c* and at least one outlet port 3*d* are formed in at least one end plate. Depending upon the use to which the pump/motor unit may be put, one or more inlet and outlet ports may be formed in each end plate. Crankshaft 14 (FIG. XVIII) extends through the power side end plate 3. When the unit is to be used as a pump, the crankshaft 14 is connected to a power source by any of the various well known means. In similar manner, when the unit is to be employed as a motor, the crank shaft 14 is coupled to the device to be driven.

The housing for the controller unit is similar to that of the pump/motor unit. The cylindrical sleeve 1 continues from the pump/motor unit to enshroud the controller unit. This unit also has two end plates, 30 being the end plate abutting the output side end plate 3*a* of the pump/motor unit and 30*a* being the outside end plate of the controller unit. The controller unit is connected to the pump unit by housing bolts 31*b* which are secured in the outer surface of end plate 3*a* of the pump/motor unit. Control rod assembly 54 of the controller unit has journals 54*a* in controller end plates 30 and 30*a* FIG. XXIV. Control rod cam assembly 55 actuates the controller cams, of which only outer controller cam sleeve 51 is visible in FIG. I as will be explained subsequently.

FIG. II, the output end plate 3*a* has on its interior surface a recess 2*a* for the adaptor plate 2 seen in FIG. III. The power side end plate 3 has an identical recess on its interior surface. Aperture 14*d* receives the pump-/motor crankshaft assembly seen in FIGS. V–VII and XVI. The apertures 10 for the housing bolts 3*b* have a seal 11 in end plate 3*a*. In end plate 3 the housing bolts are received in tapped holes 10*b* and require no seals. The inlet and outlet ports 3*c* and 3*d* respectively in end plate 3*a* match up with circular conduits on the underside of adaptor plate 2 as will be subsequently seen. A plurality of L-shaped grooves 21 are formed in the inner surface of end plates 3*a* to provide for the influx of fluid to be pressurized in the instance of use of the pump/motor unit as a pump or of pressurized fluid when the unit is being employed as a motor. Similarly, an equal plurality of opposing L-shaped grooves 22 is formed in the surface of end plate 3*a* to provide an outlet for the fluid pressurized when the unit is employed as a pump and an outlet for the de-pressurized or reduced pressurized fluid received when the unit is employed as a motor. The structural and operational relationships of grooves 21 and 22 with the cylinders and pistons and the adaptor plate will be explained subsequently. Port 12*a* receives lubricating fluid for the crankshaft, cylinder and piston assemblies as will be explained.

As seen in FIG. III, the underside of the adaptor plate 2 contains a plurality of concentric channels formed in the surface of the underside about the aperture 14*d* for the crankshaft. Channel 12*e* receives the lubricating fluid from port 12 (FIG. II). The lubricating fluid from this channel is conducted to the various bearings through port 24 as will be explained. The lubricating fluid is returned through port 25*a* into channel 25. The incoming fluid which is to be pressurized within the pump or is under pressure when the unit is a motor is received from inlet port 3*c* in the end plate 3*a* into channel 28. The outgoing fluid from the pump/motor unit flows around channel 27 to outlet port 3*d* in end plate 3*a*. The adaptor plate for end plate 3 may contain the same number of concentric channels and lubricating ports or the channels 27 and 28 may be omitted since the fluid inlet and outlet ports are not normally provided on end plate 3. In some usages, fluid inlet and outlet ports may be necessary on both end plates. In the instance when hydraulic fluid is employed, a separate lubricating oil will not be required. Instead, a small quantity of the pressurized hydraulic fluid will be passed into the channel 25 for circulation for lubrication of the various bearings and seals and returned into channel 12 to be passed through the lubricating route provided and explained subsequently. This will require making a small cut in the wall between channels 28 and 25. A peripheral channel 30 is formed in the edge of adaptor plate 2 to receive any lubricating fluid which may pass by the cylinder and piston seal assemblies. It is drained from channel 30 by port 26 (FIGS. IV and V) and will collect in the bottom of the housing from whence it may be drained by plug 1*a* FIG. VIII.

In FIG. IV, the novel elements shown in FIGS. II and III have been placed in operational relationships and other novel elements of the invention have been added. The upper side of the adapter plate 2 has not been shown separately but since it contains but a few openings, it can be seen with sufficient clarity in FIG. IV.

When the adapter plate is inserted in operational relationship to the end plate 3*a*, it will be seen that the L-shaped slots 21 and 22 in the interior surface of end plate 3*a* having matching extensions 21*a* and 22*a* respectively, in the surface of adaptor plate 2. The extensions 21*a* extend just beyond the inner edge of channel 28 on the underside of plate 2*a* to provide incoming flow of the fluid from channel 28 into slot 21 and into the chamber as will be explained. Similarly, extension 22*a* extends just beyond the inner edge of channel 27 on the underside of plate 2 to provide for outgoing flow of fluid from the chamber via slot 22. Since channel 27 is farther from the outer edge of plate 2, extension 22*a* is longer than extension 21*a*. The number of extensions 21*a* and 22*a* will be determined by the number of cylinders in the unit which can range from 1 to 4, although the 3 and 4 cylinder arrangements will normally be used.

Since a four cylinder arrangement is the most complex, FIG. IV is employed to show the novel sealing ring assemblies 7, each of which assemblies comprises on resilient expansible sealing ring 7*a* which is inserted in a matching recess 7*b* in both the surface of adaptor plate 2 and the surface of end plate 3*a*. The sealing ring 7*a* is an inverted U-shape with one leg angled slightly. The interior of the ring forms a channel which is closed by another ring 7*c* (FIG. VIII). When end plate 3*a* is laying with the shown surface upward, the ring protrudes slightly above the surface so that when the end plate is assembled, the cylinder of the invention will press the sealing ring back into the recess sufficiently to forming a sealing fit between the end wall of the cylinder and the surface of the end plate/adaptor plate. The outer two-thirds of the sealing ring is provided with a plurality of spaced apertures 23 for the flow of lubrication fluid into and out of the sealing ring recess for lubricating the end walls of the cylinders as well as the matching surface of the end plate/adaptor plate. In a similar manner the inner third of each sealing ring 7*a* is provided with a plurality of spaced apertures 23*a* which not only insure lubrication of this portion of the sealing ring 7*a* but also provide lubricating oil for the novel piston assemblies of the present invention as will be explained subsequently. FIG. IV for the end plate of the 4-cylinder embodiment shows that the sealing rings, and therefore the cylinders are radially positioned about the crankshaft at a 90° spacing. For the 3-cylinder embodiment the sealing rings would be positioned at 120° spacings. In the instance of a 2-cylinder embodiment, the spacing of the sealing ring assemblies would be 180° about the center line of the crankshaft. The use of only 1 cylinder is within the scope of the present invention and hence the sealing ring assembly for such an embodiment would be positioned on a radial of the end plate.

Two of the most novel aspects of the present invention are the cylinder assemblies and the piston assemblies associated therewith to provide the pivotable expansible compression chambers. The individual components, cylinder assembly and piston assembly, are shown in FIGS. IX–XIV and XXII. Their working relationship can be seen in FIGS. V–VIII.

FIGS. V, VI and VII show three embodiments of the invention and differ primarily in number of cylinder and piston assemblies.

Since only the number of components is the variant, the same reference numerals are employed in FIGS. V–VII. Again, since the 4-cylinder embodiment is the most complex, it will be the embodiment, as shown in FIG. V, upon which the detailed description is based. Generally, only one cylinder assembly and one piston assembly will be described. However, it is to be understood that such description applies to each cylinder assembly and piston assembly unless indicated otherwise.

Within the housing of the embodiment shown in FIG. V there is to be seen a compression chamber assembly D, one of four, but may be one of one, two or three. This assembly comprises a cylinder assembly 4, a piston assembly 6 and a crankshaft 14 upon which the piston assembly 6 is rotatably journaled.

The cylinder assembly 4 comprises an inverted, U-shaped cross section cylinder **4*a* with a trunnion 5 on each end. As is seen in FIG. XXII, the cylinder 4*a* is of rectangular form with a rectangular chamber 4*b* formed by the cylinder side walls 4*c* interiorly thereof. The trunnion 5 is integrally formed on each end wall 4*d* of the cylinder. As can be seen in FIG. VIII, each trunnion 5 is mounted in a trunnion recess 5*a* in each end plate. Between each trunnion 5 and its recess 5*a* are means 5*b* to provide friction-free movement of the trunnion within the recess. This means may be in the form of a bushing, a bearing or a self-lubricating material such as tetraflorochloroethylene or equivalent compositions. The friction elimination means, if a bushing or bearing, may be in the form of an insert which is fitted into the recess 5 or it may be fitted onto the trunnion 5. If a self lubricating material is used, the material may be an insert fitted into the recess 5 or fitted on the trunnion 5 or both. The choice of the friction-eliminating means 5*b* will be determined by the use of the unit and/or the composition of the fluid which will be passed through the unit. Each trunnion 5 has an axial slot 15 on the upper and lower surfaces and an annular ring 15*a* interconnecting these slots for lubricating oil received from apertures 23 in sealing ring 7*a***.

As seen in FIGS. V, VI, VII, IX–XIV, the piston assembly 6 shown has a block-like rectangular form comprising a piston head **6*a* and a piston rod 6*b* formed integrally with the piston head. The block-like form simplifies manufacture since it may be made from a rolled or drawn rod of proper cross-section. The piston head has vertical side walls 6*c* and end walls 6*d*. In the piston head shown in the foregoing Figures just mentioned, the vertical side and end walls 6*c* and 6*d* have a peripheral recess 6*e* parallel to and spaced vertically downwardly from the piston head surface 6*f*. This recess 6*e* holds the novel pressure and lubricating sealing ring assembly 8 of the present invention. As seen in FIG. XIV and XV with reference to the FIG. VI, this novel ring assembly comprises two sets of two pairs of identical, rectangularly formed, notched plates 8*a* and 8*b*. Each pair is pivotally joined at their respective intersection by a connecting pin 8*c*. Each pair also has on its inner face 8*d* a vertical slot 8*e* which receives an end of the piston sealing assembly spring 8*f* which, as can be seen in FIGS. XIV and XV is flat with curved ends to be fitted into slots 8*e*, the spring resting against the inner wall 6*g* of recess 6*e*. In this manner, the spring maintains a free spacing between the sealing plates and the inner wall 6*g* of recess 6*c* for flow of lubricating oil in the recess and out through apertures 19 in the piston sealing plates into the groove 18** on the outer side of the plate.

The piston head top surface **6*f* of the piston head is joined to the vertical end and side surfaces 6*c* and 6*d* by a chamfered surface 6*h***. The purpose of the chamfered edge is to allow the piston head to rise within the cylinder chamber to the fullest extent possible, including substantially full contact between the cylinder chamber upper surface and the piston head top surface.

As seen in FIGS. IX and X the piston rod **6*b* is substantially a rectangular block depending from the underside of the piston head and is made integral therewith with a rounded lower end 6*j*. The rod 6*b* has an aperture 6*k* to receive the crankshaft 14. The aperture 6*e* retains the piston rod crankshaft bushing 6*m*. The piston rod crankshaft bushing 6*m* may be of a roller bearing type well known in the art. To those skilled in the art, it will be apparent that a recess (not shown) may be formed on each side of the piston rod crankshaft aperture 61 for the insertion of well known ball bearing races. Alternatively, depending upon the use of the invention, bushings in the form of bearings, per se, may be omitted and an insert of a self-lubricating, friction free material such as tetraflurochloreythylchloride or other similar well known material having the same properties may be placed within the aperture 61 and a complimentary coating of the same material may be placed on the crankshaft. Within the scope of the invention, piston rod 6*b*** has a lesser width along the axis of the crankshaft as shown in FIG. X, i.e., forming a T-shape.

The piston rod of the present invention is unique and novel in comparison with the present state of the art of piston rods in that there is no need to provide the portion of the piston rod which encircles the crankshaft with an upper and lower segment which must be bolted together. Additionally, there is no articulation between the cylinder and piston.

The pistons employed in the present invention differ from each other only in the structure of the piston rod in the various embodiments shown in FIGS. IX–XIII. The piston rods, however, have a common feature and that is, equal cross-sectional area. Thus, the number 2–4 pistons shown in FIGS. XI–XIII have two depending spaced piston rods **6*b* in order to be accommodated on the crankshaft 14** in a straddling fashion as can be seen in FIG. VIII.

In addition to the lubrication for the piston head previously provided, means are provided on the piston rods to lubricate the piston rod crankshaft bushing as well as conduct oil from the piston sealing recess **6*c* to the bearing; an aperture 16 is formed on each side of each piston rod 6*b* intersecting piston lubrication channel 20 and being connected by channel 17 passing along the face of the piston rod and becoming a bore 17' as it passes through the piston head to piston seal recess 6*e***.

Another aspect of the novel piston of the present invention which is common to all forms of the piston is the arcuate under surface **6*i* of each piston head. This arcuate surface accommodates the arcuate end 6*j* of each other piston rod. This arcuate surface is formed on each side of each piston rod with the exception of the piston rod on the number 4 piston. On this latter piston, the arcuate surface is formed only between the inner surfaces of each piston rod, the outer surface of each piston rod of a number 4** piston being flush with the piston head.

Referring now to FIG. VIII, and reading generally from left to right, a fitting plate E, indicated in phantom, may be provided to provide support between the pump/motor unit A and the power source (not shown) so that the weight of the unit A is not borne by the crankshaft 14*a* as end portion 14*f* is connected to the power shaft (not shown) by known devices such as keying (not shown). In lieu of fitting plate E, a footed plate (not shown) may be used when the unit A is to be supported on the mounting for the power source. In either instance, it is contemplated that such supporting plate would be bolted to the external face of end plate 3 in a conventional manner. Other forms of support for unit A will occur to those of skill in the art.

In assembly of unit A, end plate 3 is placed horizontal with its interior surface upward. The trunnion seals 5*a* are then inserted into the trunnion seal recesses 5*b* in end plate 3. The adaptor plate 2 is then inserted into the adaptor plate recess 2*a* in end plate 3. The cylinder sealing ring assemblies 7*a* and 7*c* are then inserted into the cylinder sealing recesses 7*b,* one for each cylinder in the embodiment employed in the adaptor plate 2 inserted in end plate 3. Cylindrical sleeve seal 9 is inserted in sleeve seal recess 9*a* in end plate 3.

Each piston assembly is put together by placing a piston sealing spring 8*f* in the recesses 8*e* in each of a pair of piston sealing rings 8*a* and 8*b* pivotally pinned together by pin 8*c* (FIG. XIV*a, b, c*) and the placing of each of the pairs in the piston sealing ring recess 6*e* in each piston. The crankshaft bearings 13 are inserted into the crankshaft bearing recesses 61 in each piston rod 6*b.*

Each compression chamber assembly is then assembled by inserting each piston assembly into the inner chamber 4*b* of the cylinder 4*a* so that the piston sealing ring pairs 8*b* which are biased by piston sealing ring spring 8*f* and are in contact with the inner walls 4*c* of the chamber 4*b,* thus leaving the piston sealing ring pairs 8*a* on each open end of each cylinder.

The assembly of the crankshaft is then begun. The crankshaft sleeve 14*a* (FIGS. XVI–XIX) is placed on the end of the crankshaft which is to be inserted in end plate 3. The crankshaft/sleeve bearing 13 is inserted in crankshaft bearing recess 14*b* in end plate 3. It is to be noted (FIGS. XVI–XIX) that the centerline of the crankshaft is parallel but spaced from the centerline of the sleeve.

Each compression chamber assembly in the embodiment to be employed is then placed in proper relationship with the other compression assemblies so that the piston rod 6*b* of each assembly is in proper relationship to the other piston rods whereby a cylindrical form of the length of the cylinder is formed. As seen in FIG. VIII, piston rod 6*b* No. 1 is straddled by piston rod 6*b* No. 2, which in turn is straddled by piston rod 6*b* No. 3.

With the compression chamber assemblies thus properly aligned, the end of the crankshaft 14 opposite the end bearing the crankshaft sleeve 14*a* is then inserted through the crankshaft bearings 13 which are mounted in the crankshaft bearing recesses 6*e* in each piston rod until the piston rods are flush with surface 14*d* of the crankshaft 14.

With end plate 3 lying horizontally with the cylinder sealing ring assemblies upward, the crankshaft carrying the compression chamber assemblies is then slid into the crankshaft bearing 13 in end plate 3. The assemblies are pivotally moved around the crankshaft until the one trunnion 5 of each assembly can be fitted into its proper recess and the crankshaft on compression chamber assemblies are moved into seating engagement with the surface of end plate 3 and adaptor plate 2 inserted therein. Cylindrical sleeve 1 is then placed into position over end plate 3 with end plate recess 1*a* abutting end plate 3.

Crankshaft sleeve 14*a* is placed over stub shaft 14*f* and crankshaft bearing 13*a* is inserted into end plate 3*a.* End plate 3*a* is then assembled in the same manner as described above with reference to end plate 3 and the portion of the pump/motor unit A previously assembled is inserted into end plate 3*a* in the manner described for end plate 3. At this juncture, the pump/motor unit is assembled by insertion of the pump/motor unit A housing bolts 3*b.*

If the thus assembled unit A is to be employed as a pump or motor without the controller unit, it will be apparent that end plate 3*a* will have a recess 14*b'* to receive the crankshaft bearing 13 and the end portion 14*f* of the crankshaft which will not be accessible from the outside of unit A. This is indicated in FIG. VIII by dotted line.

Controller B is assembled in the following general manner, (FIGS. XVI–XIX, XX, XXIII and XXIV) . Controller cam shaft keys 14*c* are inserted into controller cam shaft key recesses 50*a* in the end of controller cam shaft 50 which is to be joined to crankshaft 14. Inner controller cam key 50*a* is inserted into inner cam key recess 50*b* in controller cam shaft 50. Inner controller cam 52 is then fitted onto cam shaft 50 by sliding key 50*a* into key recess 52*a* milled into inner cam 52. As best seen in FIG. XVI, note that the center line 63 of shaft 50 is coaxial with center line 61 of the power source shaft 14*f* and that center line 64 of cam 52 is coaxial with center line 61 of crankshaft sleeve 14*a.* Outer controller cam 51 is then slid over inner control cam 52 so that the outer cam control slot 51*a* is perfectly matched in crossing pattern with inner cam control groove 52*b* , and slot 51*a'* is matched in cross pattern with groove 52*b'.*

Controller cam shaft 50 is then assembled by sliding controller cam shaft keys along recesses 14*e* in crankshaft 14; controller end plate 30 is then fitted over the controller cam shaft as assembled by sliding the cam shaft aperture 30*a* over the assembled shaft until the end plate 30 is in contact with end plate 3*a.* Control rod assembly journal 45*a* is inserted into journal recess 30*b* in end plate 30.

Control rod assembly 54 comprises a control shaft 54*b,* one end of which is to be fitted into journals 54*a* in end plate 30, the opposite end having a perpendicularly extending lever 54*c* which is employed to turn the control shaft as will be explained subsequently.

The lever 54*c* is secured on control shaft 54*b* and is mounted on upper control cam assembly 55. The assembly comprises a camming unit 55*a* having a camming groove 55*b,* The camming unit 55*a* can be secured to the shaft 54*b* by a key 55*c,* a set screw or similar devices, or the camming unit may be formed by milling a piece of stock to produce the shaft 54*b* and the camming unit 55*a* as an integral part thereof. The camming unit 55*a* further includes an upper cam roller 55*d* positioned within camming groove 55*b.* The roller 55*d* is rotatably mounted on shaft 55*c* which is fixedly positioned in cam assembly housing 55*e.* Cam assembly housing 55*e* has a cylindrical form as can be seen in FIG. XXIV with due reference to FIG. VIII. Camming unit 55*a* also includes a stabilizer plate 55*f* which extends parallel to control shaft 54*b,* is securable to the interior surfaces of controller end plates 30 and 30*a* and carries a slot 55*g* which is fitted around and precludes the rotational movement of cam assembly housing 55*e* during operation of the pump/motor unit.

The cam assembly housing 55e surrounds a controller cam housing 55h which has an aperture 55s to accept outer and inner controller cams 51 and 52 and carries the lower roller cams 55i and 55j which are fitted into the cam slot 51a and 51a' and cam groove 52b and 52b' respectively in outer controller cam 51 and inner controller cam 52 respectively. The roller cams 55i and 55j are rotatably mounted on lower roller cam shafts 55k which are mounted in bores 55l in the housing 55h. Each upper surface of roller cam shaft 55k has a keyway 55m which matches a keyway 55n in the upper surface of each bore 55l. A key 55p is fitted into keyways 55m and 55n to secure the roller cam shaft 55k within housing 55h and also to prevent rotation of the roller cam shaft.

The cam assembly housing 55e has closed back surface 55t with a bore to fit over the controller cams. The housing 55h is fitted over the controller cams into contact with a first roller bearing assembly 55r mounted on the inner surface of housing back 55t. A second roller bearing assembly 55u in an assembly mounting plate 55u' is inserted into a recess 55v in housing 55e and provides rotational support against uncontrolled lateral movement of housing 55h. Roller bearing assembly 55u is held in recess 55v by a split ring 55w insertable into a groove 55x in housing 55e.

FUNCTIONING OF CONTROLLER UNIT

When the elements of the controller unit are in the positions shown in FIGS. VIII and XXIII and XXIV, the unit permits the pump/motor unit to function with full output of pressurized fluid as will be described subsequently.

In the position of elements shown in FIGS. VIII and XXIII, the lever 54c is in an upright position. The upper control cam assembly 55 is stationary. Within the cam assembly housing 55e, the housing 55h will rotate since the inner and outer controller cams 51 and 52 are rotating with controller cam shaft 50 which is locked to crankshaft 14, and the roller cams 55i and 55j are held in their positions in cam slot 51a and cam groove 52b by the fact that cam shaft 55k is secured in housing 55h which is rotating about shaft 50 because key 55p locks housing 55h and cam shaft 55k against independent movement.

The rotation of control lever 54c on shaft 54 in a counter clockwise direction produces a rotational movement of camming unit 55a. As camming unit 55a is rotated by shaft 54, camming groove 55b, by its rotation, causes upper camming roller 55d to move in camming groove 55b towards the pump/motor unit. As camming roller 55d moves, its connection to cam assembly housing 55e causes this housing to move equally toward the pump/motor unit. The movement of housing 55e, even though this housing is rotating about shaft 50, moves lower camming rollers 55i along camming slots 51a and 51a' in outer controller cam 51 thereby rotating outer controller cam 51 in a clockwise direction while simultaneously moving lower camming rollers 55j along camming slots 52b and 52b' in inner controller cam 52 thereby causing inner controller cam 52 to rotate in a counter clockwise direction. As inner controller cam 52 rotates in the counter clockwise direction, such rotation causes controller cam shaft 50 to similarly rotate in a clockwise direction. The counter-clockwise rotation of cam shaft 50, which is keyed to the crankshaft 14 of the pump/motor unit, rotates the crankshaft sleeves 14a and 14a' which are secured to crankshaft 14. This rotation of crankshaft sleeve 14a and 14a' progressively moves the path circumscribed by the axis of rotation of crankshaft 14 above the power source shaft stub 14f from a position of parallel to, but spaced from, the centerline of the axis of rotation of the shaft of the power source to a position coaxial with the axis of rotation of the shaft of the power source as seen in FIGS. XXIa–XXIc. In this position of coaxiality, the pistons in all chamber assemblies are placed in a neutral position; i.e., the pistons will not move upwardly or downwardly as the shaft upon which they are mounted continues to rotate. In such a position the pistons cease to provide compression and decompression within the cylinders and the output from the pump/motor unit is substantially zero, thus placing the pump/motor unit in a neutral position or non-power producing status even though the power source continues to operate at the same speed or, in fact, at any speed.

To reverse the power output from the pump/motor unit, the control lever 54c is rotated clockwise to the position shown in FIG. VIII and the related elements are consequentially moved in patterns reverse to those just described and in summary, the path circumscribed by the crankshaft 14 axis of rotation is moved from coaxiality with the axis of rotation of the shaft of the power source to a position wherein the axis of rotation of the crankshaft 14 is again parallel to, but spaced from, the axis of rotation of the shaft of the power source.

Within the controller unit, the only truly continuously moving part is the controller cam housing 55h. Since this housing is not in frictional engagement with cam assembly housing 55e there is no problem of lubrication to prevent wear between the two housings. Nonetheless, all surfaces of the controller unit have a coating of any friction-free material, such as tetrachlorofluorethylene (TEFLON) or any similar material having the same friction-free properties.

In the present invention, one of the most important aspects to be understood is the crankshaft. As can be seen in FIG. VIII and FIGS. XVI–XIX from the power source shafts 14f and 14f', The crankshaft has a single offset portion 14 to which the piston rods are journaled. Referring to FIGS. XVI–XIX and XXIa–XXIc, the centerline of this offset portion is indicated by numeral 60. This centerline 60 is offset from the centerline 61 of the power source shaft stub 14f and center line 63 of shaft 50 is one-half the distance, or throw, the pistons are moved relative to the cylinders in the course of their movement as the crankshaft rotates, as will be readily recognized by those of skill in this art.

It has been previously described that the crankshaft 14 is mounted in sleeves 14a and 14a' which are eccentrically positioned with reference to the crankshaft 14 and as can be seen in FIG. VIII and FIGS. XIV–XIX. In FIG. XVI and FIGS. XXIa–XXIc it will be seen that the centerlines 62 of the sleeves and centerline 64 of cam 52r spaced from the centerline of the power shaft stub portion 14f and 14f' of the crankshaft and shaft 50 the same distance as the centerline 60 of the crankshaft portion on which the pistons are journaled but diametrally positioned relative thereto. Thus, the crankshaft sleeve centerline 62 and the piston bearing crankshaft portion centerline 60 rotate about centerline 61 in the same path but spaced 180° from each other. Similarly, cam center line 64 rotates about center line 63 which is coaxial with center line 61 but at the same distance therefrom as center line 62. This relationship is constant and fixed when the unit A is employed as a pump or a motor to produce optimum output of pressurized fluid as a pump or optimum output of rotational force as a motor. However, when the cam 52 is rotated by the lateral movement of the upper control cam housing assembly 55, this rotation is imparted to shaft 50 which in turn causes the crankshaft 14 to rotate the sleeves 14*a* and 14*a'* as described above in the functioning of the controller unit to change the output of the pump.

Functioning of the Pump/Water Unit

During the rotation of the crankshaft in its normal pressurizing or driving centerline position, the varying positions of the pistons within the cylinders and the pivotal attitudes of the various cylinders about their trunnions as a result of the rotation of the crankshaft is seen in FIGS. V–VII. Each piston on its downward stroke uncovers the inlet port 22 to draw fluid into its respective chamber by the negative pressure created by the downward movement of the piston. The piston end walls in conjunction with the cylinder end walls act as inlet valves. As each piston completes its downward movement, the inlet port is covered by the cylinder end wall as the cylinder is rotated about its trunnion. The outlet port for each chamber assembly is automatically closed by the opposite cylinder end wall due to the position of the cylinder during the downward movement of its respective piston.

As the rotation of the crankshaft continues, each piston having completed its downward or negative-pressure producing movement, begins to move upwardly within its respective cylinder. At the beginning of this movement upwardly, both inlet and outlet ports 21 and 22 are covered by the end walls of the cylinder and the fluid within the chamber is placed under increasing pressurization. Just as the optimum pressure is being attained, in the vicinity of 10,000 psi, the relative movement of the piston and its cylinder pivots the cylinder to begin to move the opposite side of the end wall sufficiently to uncover the upper portion of the outlet port 22. As the piston continues to rise in its respective cylinder, the pivotal movement of the cylinder continues to uncover the remainder of the associated outlet port and when the piston has reached the upper limit of is movement and its upper surface is substantially in contact with the upper surface of the cylinder chamber, all fluid has been exhausted from the chamber and the cycle is repeated.

The end walls of each cylinder are in constant contact with the cylinder sealing assemblies in the end walls of the pump/motor unit during the pivotal to-and-fro movement of the respective cylinder. The pistons also contact the cylinder sealing assemblies at the apex of their travel. Since the piston sealing ring assemblies have almost a vertical knife edge at each corner of the piston sealing ring assemblies, the upper and lower ends of such knife edges is slightly chamfered as shown in FIG. XIV. This chamfer acts as a cam when the piston sealing assembly contacts the cylinder sealing assembly and depresses the leading edge of the cylinder sealing assembly as the piston sealing assembly continues to ride over the cylinder sealing assembly, thereby preventing cutting of the surface of the cylinder sealing assembly by the piston sealing assembly knife edges.

The piston sealing ring assemblies are novel in concept of providing sealing for rectangular or non-circular pistons and also in their structure. As seen in FIGS. XIV*a*–XIV*d*, each assembly comprises a plurality of pairs of flat plates which overlap each other at each corner of the piston and also overlap each other along the sides and ends of the pistons. Each pair is pivotally pinned to each other at the corner intersections. Each plate of each pair which is positioned in the side wall of the sealing assembly recess in each piston has a vertical groove into which one end of a sealing assembly spring is fitted, the intermediate portion of the spring between the ends resting against the back wall of the sealing assembly recess. When the sealing ring assembly is fitted into the recess prior to the insertion of the piston into its respective cylinder, the resilience of the spring causes those elements with which it has contact to protrude slightly beyond the side walls of the piston. Since the pairs are joined at the corners by the pins, those sealing rings on the ends of the piston, in contrast to the plates in the side walls, will be drawn inwardly with reference to the recess. When the thus assembled piston is inserted into the chamber of the cylinder, the plates on the side walls which were slightly extended beyond the side surfaces of the piston head will be forced back into a position which is paralled with the side walls. Because of the pivotal connection at the corners, the plates which are positioned on the end walls of the recess will be brought out into a sealing position with the end plates of the housing. The spring thus positions the plates with which it is directly in contact into sealing engagement with the side walls of the cylinder. In this instance, the spring exercises a radial movement of the plates to insure that the piston is in a sealed, or anti-pressure release, relationship with the cylinder. At the same time, the spring exerts a longitudinal force, which is translated through the pinning of the plates at the corners to cause the plates on the end walls of the piston to establish sealing contact with the end plates of the unit through the cylinder sealing ring assemblies.

The inventive aspects of the present invention have been set forth in the specification and illustrative drawings encompassed herein. Those modifications which may take form in the minds of those of skill in this particular art are encompassed in the claims of and for the invention which follow.

What is claimed is:

1. In combination, a fluid pump/motor unit comprising a cylindrical housing within which there is arranged at least one rectangular expansible chamber assembly mounted on a crankshaft having at least a portion thereof which is adjustably displaceable from the axis of the housing, each end of said displaceable portion being eccentrically mounted in the opposing ends of said housing, and means to supply and receive fluid to and from said unit, a power source having a connection to one end of said shaft, which connection is co-axial with said housing axis; and means coupled to said unit to control the output of said unit irrespective of the speed of said power source by varying said displacement of said shaft portion the control means comprising a housing connected at one end to said unit, a first shaft journaled in said housing and keyed to the end of the displaceable portion of the shaft in the pump/motor unit, a first camming unit keyed to said first shaft and comprising a concentrically positioned pair of cylindrical sleeves encircling said first shaft, the inner sleeve being secured to said first shaft, the axis of said sleeves being parallel to but spaced from the axis of said first shaft each sleeve having a helical path in the wall of each, said helical paths lying at right angles to each other and forming a moving intersection of said paths so that the inner sleeve can be rotated counter to the rotation of the outer sleeve, means encircling said sleeves with means to engage said paths so as to rotate with said sleeves, a second camming unit holding said first camming unit in rotational relationship to said second unit and mounted on a second shaft in said controller unit housing, said second shaft being parallel to, but spaced from, said first shaft, means to restrain said second camming unit against rotational movement, said second camming unit including means for linear movement along said second shaft to move said encircling means over said sleeves to move said path engaging means along said paths to rotate said first shaft to vary said displacement of said shaft portion.

2. The combination according to claim 1 wherein said first camming unit comprises a first cam cylinder with keyway in one end portion and a bore in said end portion to receive said first shaft, a second cam cylinder rotatably fitted over said first cylinder, a first pair of diametrically positioned helical grooves formed in the outer surface of said first cylinder, each groove of said first pair extending 180° of the circumference of said first cylinder in opposite directions on said circumference, a second pair of diametrically positioned helical slots formed in the wall of said second cylinder and extending 180° of the circumference of said second cylinder in opposite directions, said slots being 180° out of phase with said grooves but having movable intersections along their respective length as said cylinders rotate counter to each other, a cylindrical housing surrounding said first and second cylinders and having a pair of opposed radial bores, each bore having a rod extending through said bore into the said slot and groove adjacent said bore, the end portion of each rod extending into said slot and groove carrying a pair of rollers so positioned that one roller is rotatable within said groove and the other roller is rotatable within said slot.

3. The combination according to claim 1 wherein said second camming unit comprises a cylindrical housing with a closed back which has an aperture to receive a portion of said first camming unit when said first camming unit is inserted therein for rotation, first annular bearing means on the inner surface of said back to journal one end of said cylindrical housing of said first camming unit, second annular bearing means in a recess on the open end of said housing of said second camming unit to journal the opposite end of said first camming unit housing, means to retain said second bearing means in said recess, cover means for said open end, said second camming unit further comprising a camming groove formed on a portion of said second shaft, a roller inserted in said camming groove, said roller being mounted on a stub shaft on the upper surface of said second camming unit housing and a lever mounted on the outer end of said second shaft to rotate same whereby said camming is similarly rotated to cause said roller therein to move linearly toward said pump/motor unit, said roller movement imparting similar movement to said second camming unit housing, the movement of said second camming unit housing imparting similar movement to said first camming unit housing and its pairs of rollers, the linear movement of said pairs of rollers imparting rotary movement simultaneously to each cam cylinder but in opposite directions with reference to each other whereby said first shaft rotates the crankshaft of said pump/motor unit to a centered position.

4. The combination according to claim 3 wherein a restraining means comprising a slotted plate is positioned around said stub shaft, said plate being parallel to said second shaft and mounted on end plates of said controller housing.

5. The fluid pump/motor according to claim 1 wherein said rectangular expansible chamber assembly comprises a rectangular assembly of a substantially U-shaped cross-section with open ends and bottom thereby forming an internal, rectangular, inverted chamber, and a rectangularly headed piston assembly insertable into said chamber for movement within said chamber.

6. The fluid pump/motor according to claim 5 wherein said rectangular assembly comprises a rectangular cylinder having an upper exterior surface which is inclined slightly upward from each of the longer sides of said cylinder to the center thereof, the end surfaces being vertical, and open, and a trunion integrally formed on each end surface of the center line of said cylinder adjacent said upper exterior surface, said trunion being insertable into a trunion recess in each respective end wall of said housing, each trunion having a lubricating groove along the upper and lower surfaces thereof and an arcuate groove around one-half of said trunion to conduct lubricating fluid between the upper and lower lubricating grooves, said chamber in said cylinder having a groove extending upwardly along the lower vertical wall of said chamber to receive lubricating fluid from said piston assembly.

7. The fluid pump/motor according to claim 6 wherein each trunnion is mounted in a trunnion bearing inserted into a recess in each end plate, each recess having trunnion sealing means inserted in the bottom thereof.

8. The fluid pump/motor according to claim 5 wherein said rectangularly-headed piston assembly comprises a piston head having a rectangular top surface and vertical side and end walls, a chamfered surface connecting said top surface with each side and end wall, a piston rod integrally formed with said head and depending therefrom across the transverse centerline of said head and with rectangular cross-section, all sides of said rod being vertical to said head, two of the opposing rod sides being extensions of said side walls of said head, the other two of said opposing rod sides being inset a predetermined distance from each end wall of said head, the undersurface of said head not occupied by said rod having a concave surface, said rod having an aperture therethrough in the lower portion to receive a crankshaft bearing, the terminal end of said portion having a convex surface.

9. The fluid pump/motor according to claim 8 wherein said piston head has a continuous recess in the side and end walls spaced below said chamfer surfaces to receive said piston sealing means, said piston rod having grooves extending from said aperture region upwardly to connect with a horizontal bore in said head and an inclined bore in said head extending from said horizontal bore to said sealing means recess.

10. The fluid pump/motor according to claim 9 wherein said piston sealing means comprise a plurality of flat plates formed into pairs, each pair being pivotally connected at one end of each plate to form a right angle, each pair comprising a long plate and a short plate, each long plate having a vertical groove on its inner surface, said sealing means further comprising a flat bowed spring with turned in ends, each said spring ends being fitted into said groove.

11. The fluid pump/motor according to claim 10 wherein a longitudinal groove is formed in the outer vertical surface of each plate, said grooves forming a continuous conduit for lubricating fluid when said pairs are assembled, each plate further having at least one aperture extending from the back wall of said groove through the width of said plate to the inner vertical surface of said plate to conduct lubricating fluid to the inner side of said sealing means.

12. The fluid pump/motor according to claim 8 wherein said piston rod is of predetermined lateral cross-sectional area.

13. The fluid pump/motor according to claim 12 wherein said predetermined cross-sectional area is in a single piston rod.

14. The fluid pump/motor according to claim 12 wherein said predetermined cross-sectional area is the sum of the cross-sectional areas of two identically sized piston rods.

15. The fluid pump/motor according to claim 14 wherein said two piston rods are dependingly spaced at predetermined positions along said under surface of said piston heads.

16. The combination according to claim 1, the chamber assembly being pivotally mounted on the end walls within the housing in sealing relationship with said end walls, at a rectangularly adapted piston assembly within said chamber assembly journaled on said shaft portion which portion has a center line of rotation parallel to, but adjustably spaced from, the center line axis of the housing, the pivotal oscillation of said chamber assembly alternately opening a first port for the flow of a fluid into said chamber and subsequently closing said first port while simultaneously opening a second port for the flow of the fluid from said chamber under compression as said piston moves toward the top of said chamber, first means to seal the end walls of the chamber assembly with the ends of the housing and second means are provided to seal the piston and cylinder of the chamber assembly during the movement of the piston therein and conduit means within the housing end walls for inward and outward flow of the fluid from said unit, and means operatively connected with said chamber assembly means to conduct lubricating fluid to the moving parts in said housing.

17. The fluid pump/motor according to claim 16 wherein said cylindrical housing comprises two opposed circular end plates, a cylindrical sleeve sealably fitted into recesses in said end plate and a plurality of bolts which sealingly pass through one of said end plates and the interior of said housing and are secured in the other of said end plates.

18. The fluid pump/motor according to claim 17 wherein said shaft comprises a first end portion extending outwardly from one of said end plates of said housing and connectable to a power source for rotation of said shaft, a mid-portion rotatable within said housing and carrying said chamber assembly means, and a second end portion rotatably journaled in the other of said end plates.

19. The fluid pump/motor according to claim 18 wherein the centerline of rotation of said mid-portion of said shaft is parallel to, but spaced from, the centerline of rotation of said end portions of said shaft which is coaxial with the centerline of the housing.

20. The fluid pump/motor according to claim 19 wherein each of said end portions is mounted eccentrically within a sleeve, the centerline of rotation of said sleeves being parallel to the centerline of rotation of said end portions, spaced therefrom a distance equal to the spacing of the centerline of rotation of said mid-portion and being diametrically opposite the centerline of rotation of said mid-portion.

21. The fluid pump/motor according to claim 17 wherein at least one of said end plates has an annular recess in its inner surface, said recess being sealingly fitted with an adaptor plate, said adaptor plate having a plurality of annular spaced grooves in its under-surface, two of said grooves being operatively connected to fluid inlet and outlet ports in said end plate, at least another one of said grooves being operatively connected to a source of lubricating fluid and at least one additional groove to return the said lubricating fluid to said fluid source.

22. The fluid pump/motor according to claim 21 wherein at least one of said end plates has at least a pair of spaced, opposed, inverted L-shaped recesses formed in its inner surface which can be covered by a chamber assembly and said adaptor plate in said end plate has a pair of paralled elongated recesses extending inwardly from the periphery with mate with said L-shaped recesses to form channels for fluid to enter and leave said chamber assembly, each of said elongated recesses having an aperture at its inner terminus through said adaptor plate to connect said elongated recesses respectively with said two grooves operatively connected to said fluid inlet and outlet ports in said end plate.

23. The fluid pump/motor according to claim 21 wherein said end plate and said adaptor plate each contain an arcuate recess in their respective exposed surfaces which interconnect to form an annular groove to receive said first means to seal the end walls of said expansible chamber assembly with the ends of said housing.

24. The fluid pump/motor according to claim 23 wherein said first sealing means comprises a split ring having a flat exposed surface to contact said chamber assembly, a first depending flange around the outer periphery of said ring, a second depending flange around the inner periphery of said ring and spaced from said first flange to provide a groove to conduct lubricating fluid around said ring and a plurality of ports in said flat surface connected to said groove for the discharge of lubricating fluid onto the end walls of said chamber assembly, said flanged portions of said ring being of a resilient material.

25. The fluid pump/motor according to claim 24 wherein said first sealing means further comprises a second ring of resilient material which is fitted between said flange ends and forms a seal between said groove and said recess and said ring.

26. A fluid pump/motor comprising a cylindrical housing, a rotatable shaft sealably journaled in said housing and having at least one portion thereof which is adjustably displaceable from the axis of said housing, at least one rectangular expansible chamber assembly means pivotally and sealably journaled at one of its ends within said housing on the ends thereof and in sealing relationship with the interior surfaces of said ends, said assembly means being rotatably journaled at its other end on said shaft portion, fluid inlet and outlet means in said ends and operatively connectable to said chamber assembly means, sealing means in said ends and operatively associated with said housing and said chamber assembly means, means for the flow of fluid to and from said pump/motor via said fluid inlet and outlet means and means in said ends operatively connected with said chamber assembly means to conduct lubricating fluid to the moving parts in said housing.

27. The fluid pump/motor according to claim 26 wherein said cylindrical housing comprises two opposed circular end plates, a cylindrical sleeve sealably fitted into recesses in said end plate and a plurality of bolts which sealingly pass through one of said end plates and the interior of said housing and are secured in the other of said end plates.

28. The fluid pump/motor according to claim 27 wherein said shaft comprises a first end portion extending outwardly from one of said end plates of said housing and connectable to a power source for rotation of said shaft, a mid-portion rotatable within said housing and carrying said chamber assembly means, and a second end portion rotatably journaled in the other of said end plates.

29. The fluid pump/motor according to claim 28 wherein the centerline of rotation of said mid-portion of said shaft is parallel to, but spaced from, the centerline of rotation of said end portions of said shaft which is coaxial with the centerline of the housing, and wherein each of said end portions is mounted eccentrically within a sleeve, the centerline of rotation of said sleeves being parallel to the centerline of rotation of said end portions, spaced therefrom a distance equal to the spacing of the centerline of rotation of said mid-portion and being diametrically opposite the centerline of rotation of said mid-portion.

30. The fluid pump/motor according to claim 27 wherein at least one of said end plates has an annular recess in its inner surface, said recess being sealingly fitted with an adaptor plate, said adaptor plate having a plurality of annular spaced grooves in its under surface, two of said grooves being operatively connected to fluid inlet and outlet ports in said end plate, at least another one of said grooves being operatively connected to a source of lubricating fluid and at least one additional groove to return the said lubricating fluid to said fluid source.

31. The fluid pump/motor according to claim 30 wherein said end plate and said adaptor plate each contain an arcuate recess in their respective exposed surfaces which interconnect to form an annular groove to receive said first means to seal the end walls of said expansible chamber assembly the the ends of said housing.

32. The fluid pump/motor according to claim 31 wherein said first sealing means comprises a split ring having a flat exposed surface to contact said chamber assembly, a first depending flange around the outer periphery of said ring, a second depending flange around the inner periphery of said ring and spaced from said first flange to provide a groove to conduct lubricating fluid around said ring and a plurality of ports in said flat surface connected to said groove for the discharge of lubricating fluid onto the end walls of said chamber assembly, said flanged portions of said ring being inserted into said annular groove, said ring being of a resilient material, said split ring having a first downward vertical cut in the upper surface of said ring, a second upward vertical cut in the said flanges spaced from first cut and a horizontal cut through said ring connecting the inner ends of said vertical cuts.

33. The fluid pump/motor according to claim 32 wherein said first sealing means further comprises a second ring of resilient material which is fitted between said flange ends and forms a seal between said groove and said recess and said ring.

34. The fluid pump/motor according to claim 26 wherein said rectangular expansible chamber assembly comprises a rectangular assembly of a substantially U-shaped cross-section thereby forming an internal, rectangular, inverted chamber, and a rectangularly-headed piston assembly insertable into said chamber for movement within said chamber, said rectangular assembly comprising a rectangular cylinder having an upper exterior surface which is inclined slightly upward from each of the longer sides of said cylinder to the center, the end surfaces being vertical, and a trunnion integrally formed on each end surface on the centerline of said cylinder adjacent said upper exterior surface, each trunnion having a lubricating groove along the upper and lower surfaces thereof and an arcuate groove around one-half of said trunnion to conduct lubricating fluid between the upper and lower lubricating grooves, said chamber in said cylinder having a groove extending upwardly along the longer vertical wall of said chamber to receive lubricating fluid from said piston assembly.

35. The fluid pump/motor according to claim 34 wherein each trunnion is mounted in a trunnion bearing inserted into a recess in each end plate, each recess having trunnion sealing means inserted in the bottom thereof.

36. The fluid pump/motor according to claim 34 wherein at least one of said end plates has at least a pair of spaced, opposed, inverted L-shaped recesses formed in its inner surface which can be covered by a chamber assembly and said adaptor plate in said end plate has a pair of parallel elongated recesses extending inwardly from the periphery with mate with said L-shaped recesses to form channels for fluid to enter and leave said chamber assembly, each of said elongated recesses having an aperture at its inner terminus through said adaptor plate to connect said elongated recesses respectively with said two grooves operatively connected to said fluid inlet and outlet ports in said end plate.

37. The fluid pump/motor according to claim 34 wherein said rectangularly-headed piston assembly comprises a piston head having a rectangular top surface and vertical side and end walls, a chamfered surface connecting said top surface with each side and end wall, a piston rod integrally formed with said head and depending therefrom across the transverse centerline of said head and with rectangular cross-section, all sides of said rod being vertical to said head, two of the opposing rod sides being extensions of said side walls of said head, the other two of said opposing rod sides being inset a predetermined distance from each end wall of said head, the under surface of said head not occupied by said rod having a concave surface, said rod having an aperture therethrough in the lower portion to receive a crankshaft bearing, the terminal end of said portion having a convex surface, said piston head having a continuous recess in the side and end walls spaced below said chamfer surfaces to receive said piston sealing means, said piston rod having grooves extending from said aperture region upwardly to connect with a horizontal bore in said head and an inclined bore in said head extending from said horizontal bore to said sealing means recess, said piston rod being of predetermined lateral cross-sectional area.

38. The fluid pump/motor according to claim 37 wherein said predetermined cross-sectional area is in a single piston rod.

39. The fluid pump/motor according to claim 38 wherein said predetermined cross-sectional area is the sum of the cross-sectional areas of two identically sized piston rods.

40. The fluid pump/motor according to claim 39 wherein said two piston rods are dependingly spaced at predetermined positions along said under surface of said piston heads.

41. The fluid pump/motor according to claim 37 wherein said piston sealing means comprise a plurality of flat plates formed into pairs, each pair being pivotally connected at one end of each plate to form a right angle, each pair comprising a long plate and a short plate, each long plate having a vertical groove on its inner surface, said sealing means further comprising a flat bowed spring with turned in ends, each said spring ends being fitted into said groove.

42. The fluid pump/motor according to claim 41 wherein a first notch is formed in each p;ate in one end portion, each first notch being half the depth of said plate and of a width equal to the width of said plate, a second notch formed in the other end portion of each plate with a depth of one-half the depth of said plate and a length greater than the width of said first notch being formed on the upper surface of said long plate and on the under surface of said short plate whereby said long and short plate overlap when the pivotal right angle is formed, the second notch being formed on the alternate upper and lower surfaces of said plates so that when said pairs are assembled to form a rectangular seal, the plates meeting between the pivotal right angles will overlap at said meeting.

43. The fluid pump/motor according to claim 42 wherein a longitudinal groove is formed in the outer vertical surface of each plate, said grooves forming a continuous conduit for lubricating fluid when said pairs are assembled, each plate further having at least one aperture extending from the back wall of said groove through the width of said plate to the inner vertical surface of said plate to conduct lubricating fluid to the inner side of said sealing means.

* * * * *

UNITED STATES PATENT AND TRADEMARK OFFICE

CERTIFICATE OF CORRECTION

PATENT NO. : 4,055,106

DATED : 25 October 1977

INVENTOR(S) : Kenneth H. FREY

It is certified that error appears in the above-identified patent and that said Letters Patent are hereby corrected as shown below:

Col. 2, line 7, delete "controller" and insert -- power source --

Col. 2, line 17, after "unit" insert -- to form a drive unit --.

Col. 2, line 30, after "assembly" insert -- to form an extended drive unit --.

Col. 3, line 36, change "Ii" to -- II --.

Col. 4, line 4, change "XIBb" to -- XIVb --.

Col. 4, line 20, delete "and XXIcr" and insert -- are --.

Col. 4, line 46, change "XVIII" to -- VIII --.

line 53, change "XVIII" to -- VIII --.

Col. 5, line 35, change "12e" to -- 12a --.

Col. 10, line 2, change "14a and 14f" to -- 14a and 14f' --.

Col. 10, line 35, change "cross" to -- crossing --.

Col. 13, line 9, change "Pump/water" to -- Pump/motor --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*